US008137428B2

(12) United States Patent
Kawakubo

(10) Patent No.: US 8,137,428 B2
(45) Date of Patent: Mar. 20, 2012

(54) EXHAUST GAS PURIFICATION APPARATUS FOR INTERNAL COMBUSTION ENGINE

(75) Inventor: Hiroyuki Kawakubo, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 528 days.

(21) Appl. No.: 12/308,116

(22) PCT Filed: Jun. 26, 2007

(86) PCT No.: PCT/IB2007/001747

§ 371 (c)(1),
(2), (4) Date: Dec. 8, 2008

(87) PCT Pub. No.: WO2008/001197

PCT Pub. Date: Jan. 3, 2008

(65) Prior Publication Data

US 2009/0272107 A1 Nov. 5, 2009

(30) Foreign Application Priority Data

Jun. 27, 2006 (JP) ..... 2006-177079

(51) Int. Cl.
*B01D 39/20* (2006.01)
*B01D 46/00* (2006.01)

(52) U.S. Cl. ..... 55/523; 55/DIG. 30; 422/177; 60/311

(58) Field of Classification Search ..... 55/522–524; 422/169–172, 177–182
See application file for complete search history.

(56) References Cited

U.S. PATENT DOCUMENTS

| | | | | | |
|---|---|---|---|---|---|
| 4,161,509 | A * | 7/1979 | Nowak | 422/179 |
| 4,397,817 | A * | 8/1983 | Otani et al. | 422/179 |
| 5,080,953 | A * | 1/1992 | Horikawa et al. | 428/116 |
| 5,555,621 | A * | 9/1996 | Tanabe et al. | 29/890 |
| 5,656,245 | A | 8/1997 | Fujisawa et al. | |
| 6,077,483 | A | 6/2000 | Locker et al. | |
| 6,605,259 | B1 * | 8/2003 | Henry | 422/179 |
| 6,635,227 | B1 * | 10/2003 | Shibata et al. | 422/179 |
| 7,378,060 | B2 * | 5/2008 | Sinha et al. | 422/179 |
| 2002/0068025 | A1 | 6/2002 | Foster et al. | |
| 2003/0180197 | A1 | 9/2003 | Nunan | |
| 2006/0213163 | A1 * | 9/2006 | Taoka et al. | 55/523 |

FOREIGN PATENT DOCUMENTS

| | | | |
|---|---|---|---|
| DE | 23 12 794 | | 9/1974 |
| EP | 0 360 591 | A2 | 3/1990 |
| EP | 1 607 596 | A1 | 12/2005 |
| JP | U-63-140118 | | 9/1988 |
| JP | A-6-126191 | | 5/1994 |
| JP | A-11-36853 | | 2/1999 |
| JP | A-2001-248429 | | 9/2001 |
| JP | A-2001-289028 | | 10/2001 |
| JP | A-2001-289041 | | 10/2001 |
| WO | WO03078026 | * | 9/2003 |

* cited by examiner

*Primary Examiner* — Duane Smith
*Assistant Examiner* — Amber Orlando
(74) *Attorney, Agent, or Firm* — Oliff & Berridge, PLC

(57) ABSTRACT

An exhaust gas control apparatus (2) for an engine includes a filter case (3) that has an internal space; a filter (4) that is arranged in the filter case (3) and that purifies exhaust gas; and a mat (5) that is arranged, in a compressed state, between the filter case (3) and the filter (4). The filter (4) is arranged in the filter case (3) with a first flange (45) of the filter (4) engaged with the mat (5) and with a second flange (46) engaged with a retainer (6).

25 Claims, 13 Drawing Sheets

EXHAUST GAS PURIFICATION APPARATUS FOR INTERNAL COMBUSTION ENGINE

FIELD OF THE INVENTION

The invention relates to an exhaust gas control apparatus for an engine, which purifies exhaust gas.

BACKGROUND OF THE INVENTION

Japanese Patent Application Publication No. 2001-289028 (JP-A-2001-289028) describes an exhaust gas control apparatus for an engine, which is mounted in a diesel engine and which traps particulate matter (PM) in exhaust gas. The exhaust gas control apparatus includes a ceramic filter, a case that houses the filter, and a mat that is wrapped around the filter. With this structure, particulate matter is trapped in a wall of the filter when the exhaust gas is passing through the filter. As a result, the exhaust gas is purified.

In the engine in which the above-described exhaust gas control apparatus is mounted, as the amount of PM accumulated in the filter increases, the pressure of the exhaust gas increases. Accordingly, if a great amount of PM is accumulated in the filter, the filter may be moved with respect to the case in the downstream direction by the pressure of the exhaust gas. When the case and the filter come into contact with each other due to the movement of the filter with respect to the case, chipping or cracking may occur in the filter. Accordingly, the possibility of contact between the case and the filter should be minimized. However, there have not been proposed any technologies for minimizing the possibility of such contact. Not only in the above-described exhaust gas control apparatus but also in any exhaust gas control apparatuses including a purification structural body that is arranged in a housing and that purifies the exhaust gas, the purification structural body may be deformed due to contact between the housing and the purification structural body. Accordingly, the possibility of contact between the housing and the purification structural body should be minimized, as in the above-described exhaust gas control apparatus.

DISCLOSURE OF THE INVENTION

The invention provides an exhaust gas control apparatus for an engine, which suppresses contact between a housing and a purification structural body due to a movement of the purification structural body with respect to the housing.

A first aspect of the invention relates to an exhaust gas control apparatus for an engine. The exhaust gas control apparatus for an engine includes a housing that has an internal space; a purification structural body that is arranged in the housing and that purifies exhaust gas; and a holding member that is arranged, in the compressed state, between the purification structural body and the housing. The purification structural body includes a main body that has an exhaust passage through which the exhaust gas flows and an assisting body that is provided on the outer peripheral face of the main body. The purification structural body is arranged in the housing with the holding member and the assisting body engaged with each other.

In the exhaust gas control apparatus for an engine according to the first aspect of the invention, the movement of the purification structural body with respect to the housing is restricted by engagement of the holding member with the assisting body. It is therefore possible to suppress contact between the housing and the purification structural body due to the movement of the purification structural body with respect to the housing.

A second aspect of the invention relates to an exhaust gas control apparatus for an engine. The exhaust gas control apparatus for an engine includes a housing that has an internal space; a purification structural body that is arranged in the housing and that purifies exhaust gas; and a holding member that is arranged, in the compressed state, between the purification structural body and the housing. The purification structural body includes a main body that has an exhaust passage through which the exhaust gas flows and an assisting body that is provided on the outer peripheral face of the main body. The purification structural body is arranged in the housing such that the holding member and the assisting body are engaged with each other when the purification structural body moves with respect to the housing.

In the exhaust gas control apparatus for an engine, when the purification structural body moves with respect to the housing, a further movement of the purification structural body with respect to the housing is restricted by engagement of the holding member with the assisting body. It is therefore possible to suppress contact between the housing and the purification structural body due to the movement of the purification structural body with respect to the housing.

In the exhaust gas control apparatus according to each aspect of the invention described above, the holding member and the assisting body may be engaged with each other when the downstream-side end face of the assisting body comes into contact with the holding member.

A third aspect of the invention relates to an exhaust gas control apparatus for an engine. The exhaust gas control apparatus for an engine includes a housing that has an internal space; a purification structural body that is arranged in the housing and that purifies exhaust gas; and a holding member that is arranged, in the compressed state, between the housing and the purification structural body. The purification structural body includes a main body that has an exhaust passage through which the exhaust gas flows and an assisting body that is provided on the outer peripheral face of the main body. The movement of the purification structural body is restricted by engagement of the holding member with the assisting body, when a force that moves the purification structural body with respect to the housing in the downstream direction is applied to the purification structural body.

In the exhaust gas control apparatus for an engine according to the third aspect of the invention, the movement of the purification structural body is restricted by engagement of the holding member with the assisting body. It is therefore possible to suppress contact between the housing and the purification structural body due to the movement of the purification structural body with respect to the housing.

A fourth aspect of the invention relates to an exhaust gas control apparatus for an engine. The exhaust gas control apparatus for an engine includes a housing that has an internal space; a purification structural body that is arranged in the housing and that purifies exhaust gas; and a holding member that is arranged, in the compressed state, between the housing and the purification structural body. The purification structural body includes a main body that has an exhaust passage through which the exhaust gas flows and an assisting body that is provided on the outer peripheral face of the main body. The assisting body and the holding member face each other with a clearance left between the downstream-side end face of the assisting body and the holding member.

In the exhaust gas control apparatus for an engine according to the fourth aspect of the invention, when the purification structural body moves with respect to the housing, the holding member and the assisting body are engaged with each other. Accordingly, a further movement of the purification structural body with respect to the housing is restricted. It is therefore possible to suppress contact between the housing and the purification structural body due to the movement of the purification structural body with respect to the housing.

In the exhaust gas control apparatus according to the fourth aspect of the invention, the amount of the clearance left between the assisting body and the holding member may be set such that, when the purification structural body moves with respect to the housing in the downstream direction, the assisting body comes into contact with the holding member before the purification structural body comes into contact with the housing.

In the exhaust gas control apparatus for an engine according to any one of the first to fourth aspects of the invention, the assisting body may be provided at the upstream-side end portion of the purification structural body.

In this exhaust gas control apparatus for an engine, the holding member is less likely to be exposed to the exhaust gas, because the assisting body is provided at the upstream-side end portion of the purification structural body. It is therefore possible to suppress degradation of the holding member.

A fifth aspect of the invention relates to an exhaust gas control apparatus for an engine. The exhaust gas control apparatus for an engine includes a housing that has an internal space; and a purification structural body that is arranged in the housing and that purifies the exhaust gas. The purification structural body includes a main body that has an exhaust passage through which the exhaust gas flows and an assisting body that is provided on the outer peripheral face of the main body. The purification structural body is arranged in the housing with the holding member and the assisting body engaged with each other.

In the exhaust gas control apparatus for an engine according to the fifth aspect of the invention, the movement of the purification structural body with respect to the housing is restricted, because the purification structural body is arranged in the housing with the housing and the assisting body engaged with each other in advance. It is therefore possible to suppress contact between the housing and the purification structural body due to the movement of the purification structural body with respect to the housing.

In the exhaust gas control apparatus according to the fifth aspect of the invention, the housing and the assisting body may be engaged with each other when the downstream-side end face of the assisting body and a portion of the housing come into contact with each other.

The exhaust gas control apparatus for an engine according to the fifth aspect of the invention may further include a holding member that is arranged, in the compressed state, between the housing and the purification structural body.

In the exhaust gas control apparatus according to the fifth aspect of the invention, the assisting body may be provided at the upstream-side end portion of the purification structural body.

In the exhaust gas control apparatus for an engine thus structured, the holding member is less likely to be exposed to the exhaust gas, because the assisting body is provided at the upstream-side end portion of the purification structural body. It is therefore possible to suppress degradation of the holding member.

A sixth aspect of the invention relates to an exhaust gas control apparatus for an engine. The exhaust gas control apparatus for an engine includes a purification structural body that purifies exhaust gas; and a housing that stores the purification structural body. The purification structural body including a main body that has an exhaust passage through which the exhaust gas flows and an assisting body that is provided on the outer peripheral face of the main body is provided with a restricting member that restricts the movement of the purification structural body with respect to the housing in the downstream direction. The purification structural body is arranged in the housing with the restricting member and the assisting body engaged with each other.

In the exhaust gas control apparatus for an engine according to the sixth aspect of the invention, the movement of the purification structural body with respect to the housing is restricted by engagement of the restricting member with the assisting body. It is therefore possible to suppress contact between the housing and the purification structural body due to the movement of the purification structural body with respect to the housing.

In the exhaust gas control apparatus for an engine according to the sixth aspect of the invention, the restricting member and the assisting body may be engaged with each other, when the downstream-side end face of the assisting body and the restricting member come into contact with each other.

In the exhaust gas control apparatus for an engine according to the sixth aspect of the invention, the restricting member may be arranged so as not to block the exhaust passage formed in the main body of the purification structural body.

In the exhaust gas control apparatus for an engine thus structured, an increase in the pressure of the exhaust gas is suppressed. It is therefore possible to restrict the movement of the purification structural body using the restricting member and to suppress an increase in the pressure of the exhaust gas.

In the exhaust gas control apparatus for an engine according to the sixth aspect of the invention, the restricting member may be a retainer. Alternatively, the restricting member may be a portion of the housing.

The exhaust gas control apparatus for an engine according to the sixth aspect of the invention may further include a holding member that is arranged, in the compressed state, between the housing and the purification structural body.

In the exhaust gas control apparatus for an engine according to each aspect of the invention, the holding member may be a mat made of alumina fibers.

In the exhaust gas control apparatus for an engine according to each aspect of the invention, a clearance may be left between the outer peripheral face of the assisting body and the housing.

In the exhaust gas control apparatus for an engine thus structured, it is possible to suppress promotion of an abrasion and deformation of the assisting body due to contact between the housing and the assisting body. In the exhaust gas control apparatus for an engine according to each aspect of the invention, the assisting body may be a flange provided on the main body of the purification structural body.

The outer diameter of the assisting body may be larger than the inner diameter of the holding member.

A seventh aspect of the invention relates to an exhaust gas control apparatus for an engine. The exhaust gas control apparatus for an engine includes a housing that has an internal space; a purification structural body that is arranged in the housing and that purifies exhaust gas; and a holding member that is arranged, in the compressed state, between the housing and the purification structural body. A shock-absorbing member is provided on the downstream-side end face of the purification structural body.

In the exhaust gas control apparatus for an engine according to the seventh aspect of the invention, when the purification structural body moves with respect to the housing, the shock-absorbing member and the housing come into contact with each other. It is therefore possible to suppress contact between the housing and the purification structural body due to the movement of the purification structural body with respect to the housing.

In the exhaust gas control apparatus according to the seventh aspect of the invention, the purification structural body may include a main body that has an exhaust passage through which the exhaust gas flows and an assisting body that is provided on the outer peripheral face of the main body, the downstream-side end face of the assisting body may be the downstream-side end face of the purification structural body, and the shock-absorbing member may be provided to the assisting body.

In the exhaust gas control apparatus for an engine thus structured, the exhaust passage formed in the main body of the purification structural body is not blocked by the shock-absorbing member. It is therefore possible to suppress contact between the housing and the purification structural body using the shock-absorbing member and to suppress an increase in the pressure of the exhaust gas.

An eighth aspect of the invention relates to an exhaust gas control apparatus for an engine. The exhaust gas control apparatus for an engine includes a housing that has an internal space; a purification structural body that is arranged in the housing and that purifies exhaust gas; and a holding member that is arranged, in the compressed state, between the housing and the purification structural body. A shock-absorbing member is provided on the inner peripheral face of the housing, which faces the downstream-side end face of the purification structural body.

In the exhaust gas control apparatus for an engine according to the eighth aspect of the invention, when the purification structural body moves with respect to the housing, the shock-absorbing member and the housing come into contact with each other. It is therefore possible to suppress contact between the housing and the purification structural body due to the movement of the purification structural body with respect to the housing.

In the exhaust gas control apparatus for an engine according to the eighth aspect of the invention, the purification structural body may include a main body that has a passage through which the exhaust gas flows and an assisting body that is provided on an outer peripheral face of the main body, the downstream-side end face of the assisting body may be the downstream-side end face of the purification structural body, and the shock-absorbing member may be provided on the inner peripheral face of the housing, which faces the downstream-side end face of the assisting body.

In the exhaust gas control apparatus for an engine thus structured, the exhaust passage formed in the main body of the purification structural body is not blocked by the shock-absorbing member. It is therefore possible to suppress contact between the housing and the purification structural body and to suppress an increase in the pressure of the exhaust gas.

In the exhaust gas control apparatus for an engine according to each aspect of the invention, the purification structural body may remove a toxic substance in the exhaust gas using a catalyst.

In the exhaust gas control apparatus for an engine according to each aspect of the invention, the purification structural body may trap particulate matter in the exhaust gas.

BRIEF DESCRIPTION OF THE DRAWINGS

The foregoing and further objects, features, and advantages of the invention will become apparent from the following description of example embodiments with reference to the accompanying drawings, wherein the same or corresponding portions will be denoted by the same reference numerals and wherein.

DETAILED DESCRIPTION OF THE EXAMPLE EMBODIMENTS

First Embodiment of the Invention

Hereafter, a first embodiment of the invention will be described with reference to FIGS. 1 to 9. The following description will be made on the assumption that an exhaust gas control apparatus 2 according the first embodiment of the invention is mounted in a diesel engine (engine) 1.

Figure 1:
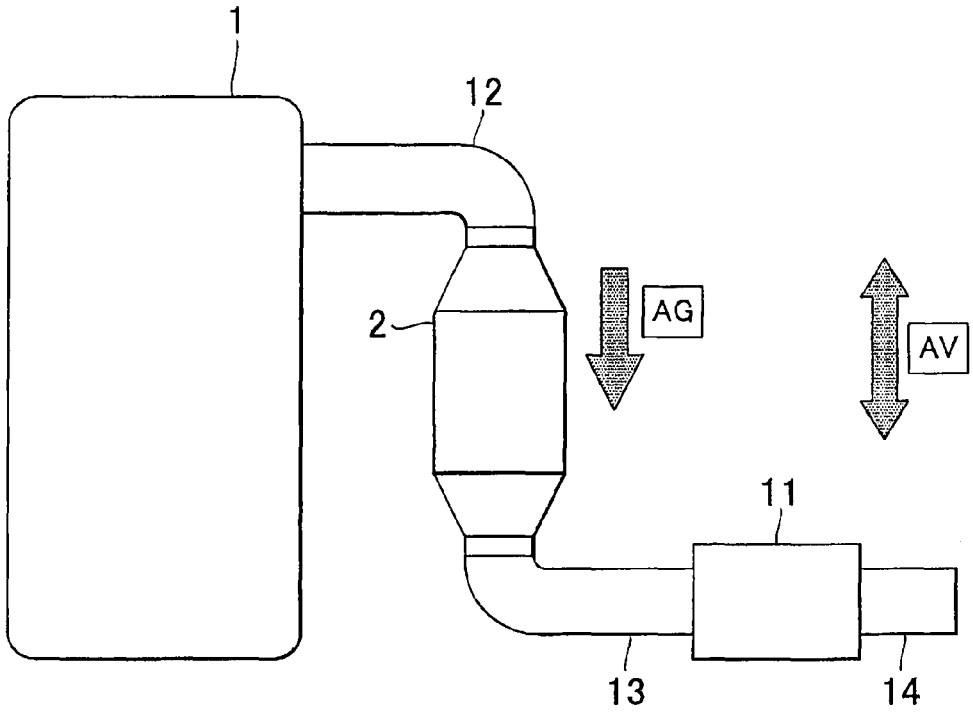
FIG. 1 is the view schematically showing the structure of an exhaust system of an engine, in which an exhaust gas control apparatus for an engine according to a first embodiment of the invention is mounted.

First, the structure of an exhaust system of the engine 1 will be schematically described with reference to FIG. 1. The exhaust system of the engine 1 includes the exhaust gas control apparatus 2 that purifies the exhaust gas, and a muffler 11 that decreases the temperature and pressure of the exhaust gas. The engine 1 and the exhaust gas control apparatus 2 are connected to each other by a first exhaust pipe 12. The exhaust gas control apparatus 2 and the muffler 11 are connected to each other by a second exhaust pipe 13. The muffler 11 is connected, at its downstream-side end, to a third exhaust pipe 14. The exhaust gas control apparatus 2 is connected to the first exhaust pipe 12 and the second exhaust pipe 13 such that an exhaust passage formed within the exhaust gas control apparatus 2 extends in the vertical direction (the direction indicated by the arrow AV). In the exhaust gas control apparatus 2 according to the first embodiment of the invention, the direction in which the exhaust gas discharged from the engine 1 flows is referred to as the forward direction (the direction indicated by the arrow AG), and the direction opposite to the direction in which the exhaust gas flows is referred to as the reverse direction. When a given position in the exhaust gas control apparatus 2 is used as the reference position, the region which is on the forward direction-side with respect to the reference position is referred to as the region on the downstream side, and the region which is on the reverse direction-side with respect to the reference position is referred to as the region on the upstream side.

Figure 2:
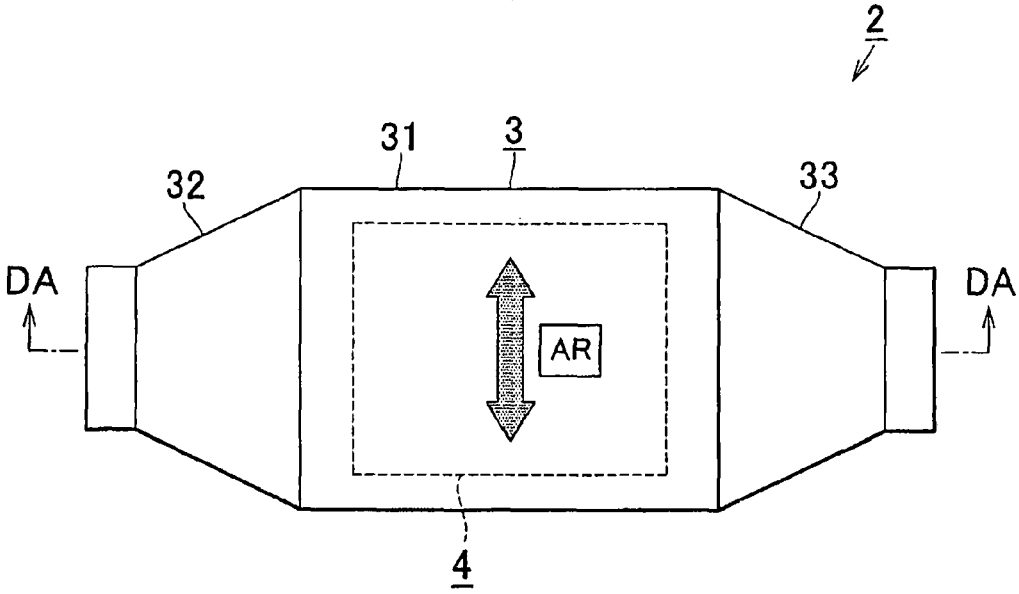
FIG. 2 is the plan view showing the plane structure of the exhaust gas control apparatus for an engine according to the first embodiment of the invention.

The structure of the exhaust gas control apparatus 2 will be schematically described with reference to FIG. 2. The exhaust gas control apparatus 2 includes a filter case 3 that is connected to the first exhaust pipe 12 and the second exhaust pipe 13, and a filter 4 that traps particulate matter (PM). The filter case 3 includes a cylindrical first case 31 that houses the filter 4, a second filter case 32 which is connected to the first case 31 and of which the diameter decreases toward the upstream-side end thereof, and a third case 33 which is connected to the first case 31 and of which the diameter decreases toward the downstream-side end thereof.

Figure 3:
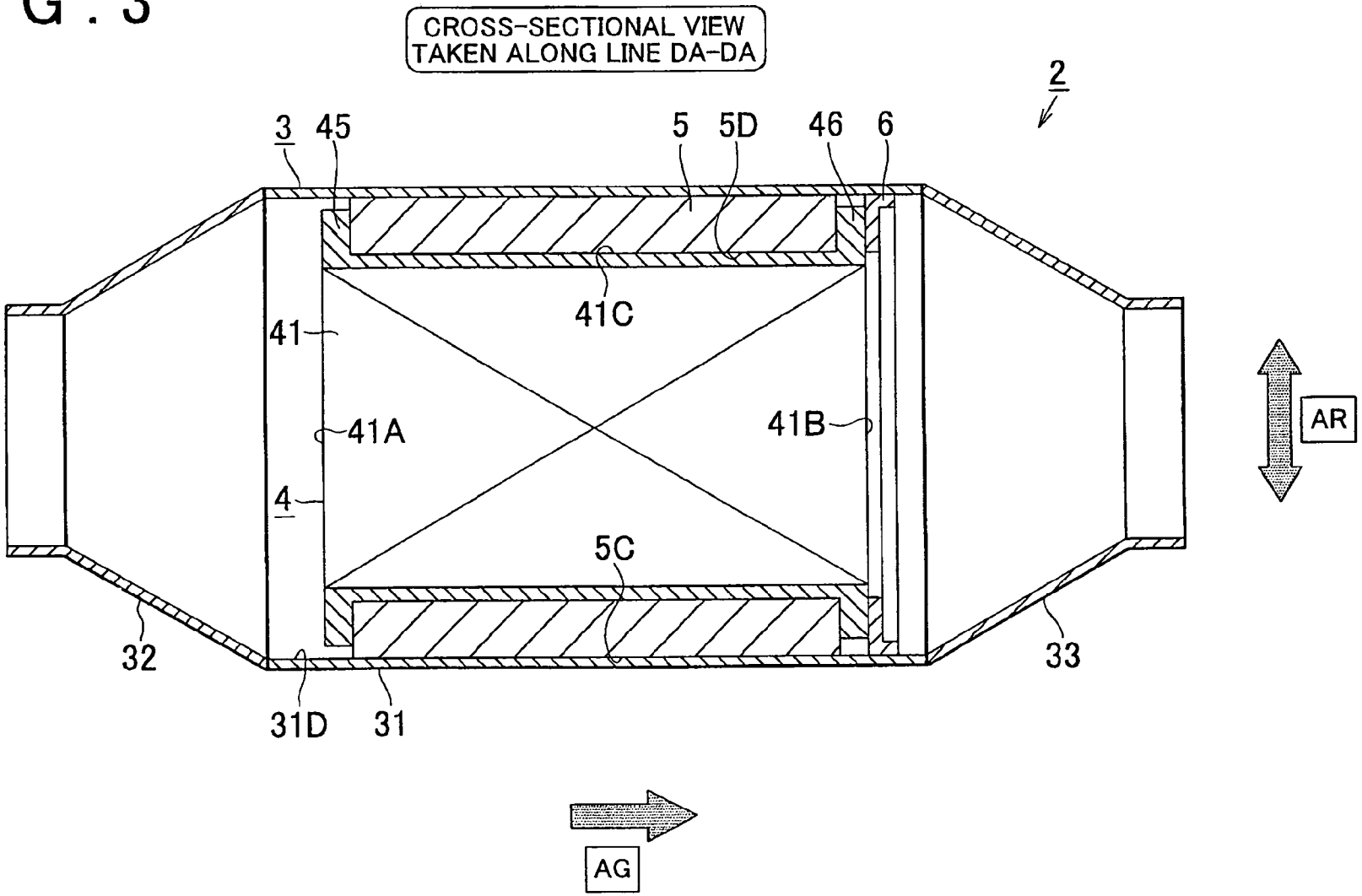
FIG. 3 is the cross-sectional view of the exhaust gas control apparatus for an engine according to the first embodiment of the invention, which is taken along the line DA-DA in FIG. 2.
Figure 4A:
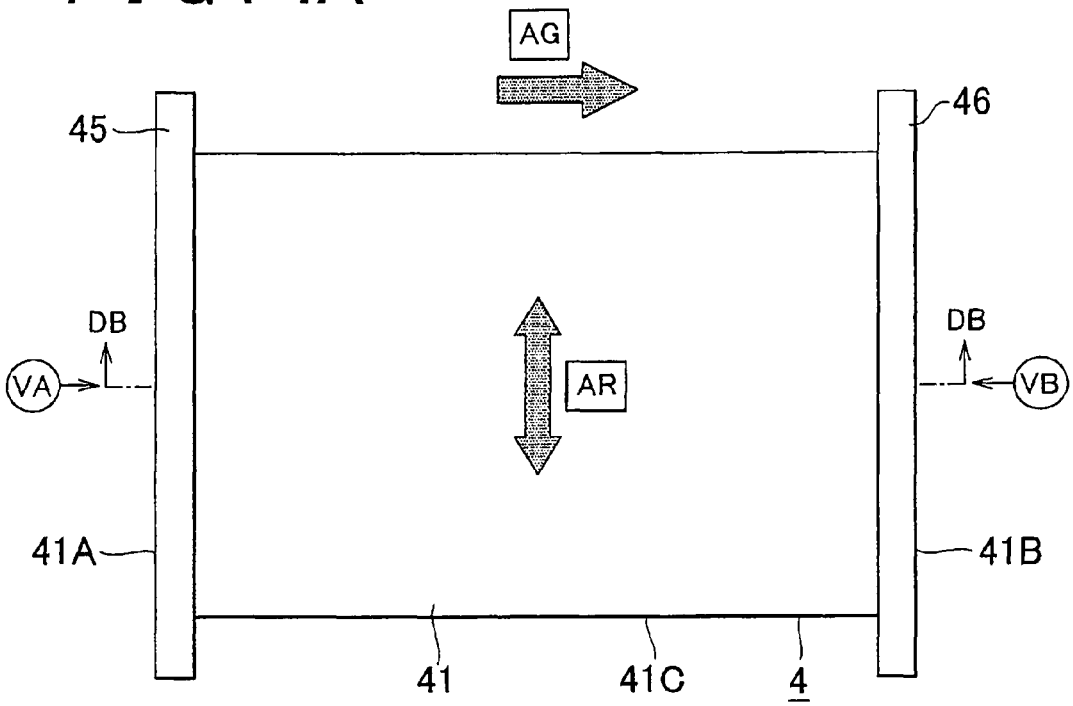
FIG. 4A is the plan view showing the plane structure of a filter included in the exhaust gas control apparatus for an engine according to the first embodiment of the invention.
Figure 4B:
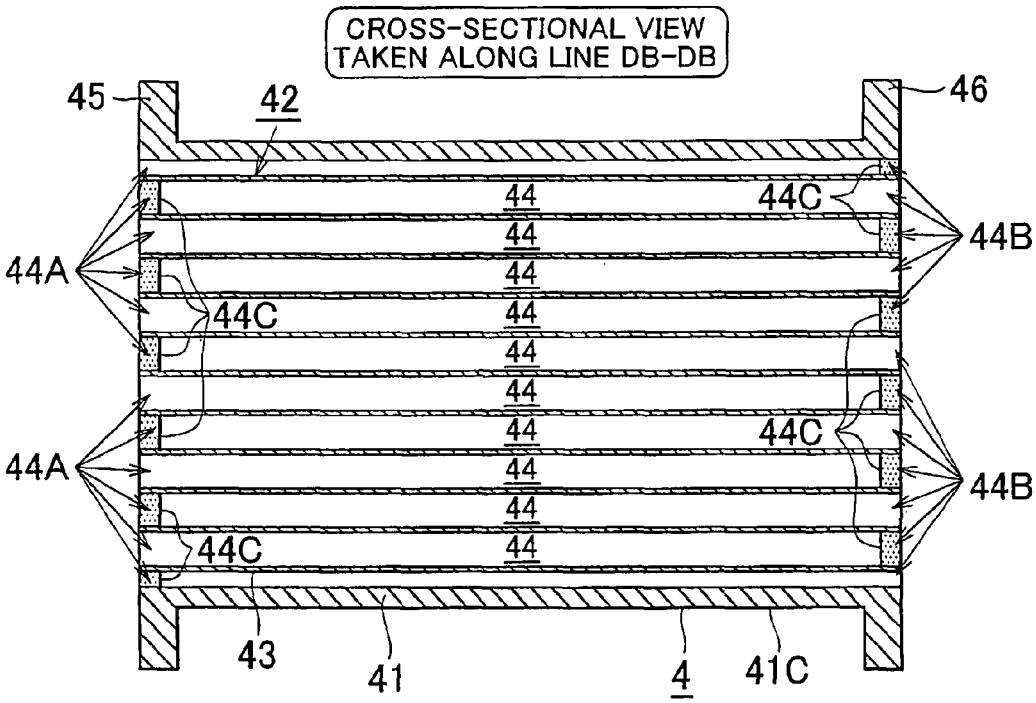
FIG. 4B is the cross-sectional view showing the cross-section structure of the filter, which is taken along the line DB-DB in FIG. 4A.
Figure 5A:
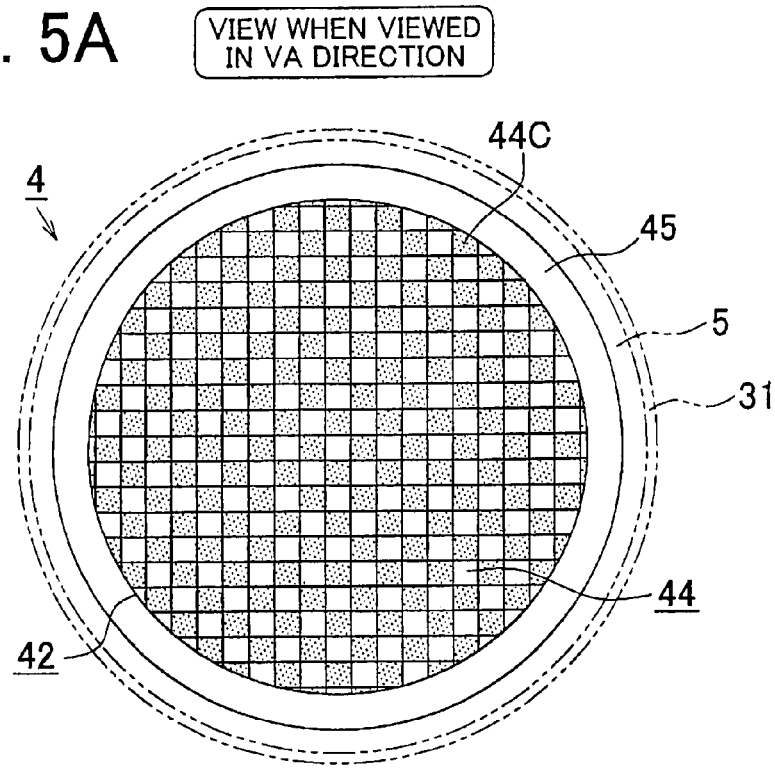
FIG. 5A is the view showing the side structure of the filter included in the exhaust gas control apparatus for an engine according to the first embodiment of the invention, when viewed in the VA direction in FIG. 4A.
Figure 5B:
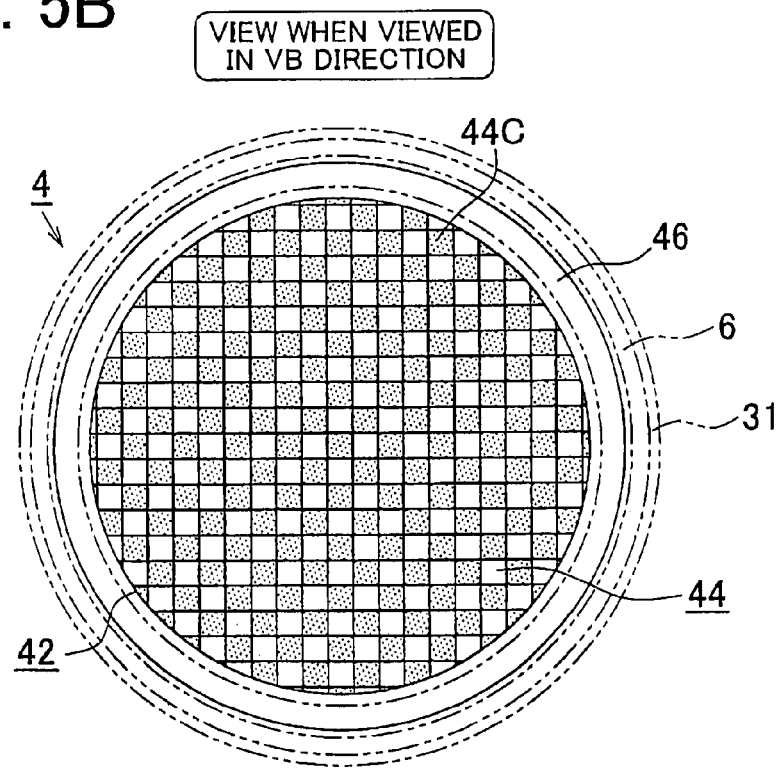
FIG. 5B is the view showing the side structure of the filter included in the exhaust gas control apparatus for an engine according to the first embodiment of the invention, when viewed in the VB direction in FIG. 4A.

The inner structure of the exhaust gas control apparatus 2 will be described with reference to FIG. 3. The arrow AR indicates the radial direction of the exhaust gas control apparatus 2. In each component of the exhaust gas control apparatus 2, a face that extends in the radial direction AR is referred to as an end face.

A heat-proof mat 5, which is made of alumina fibers, is wrapped around the filter 4. The mat 5 is arranged between the filter case 3 and the filter 4 with an outer peripheral face 5C of the mat 5 kept in contact with an inner peripheral face 31D of the first case 31 and with an inner peripheral face 5D of the mat 5 kept in contact with an outer peripheral face of the filter 4 (an outer peripheral face 41C of a filter body 41). Namely, the mat 5 is arranged, in the compressed state, between the filter case 3 and the filter 4. With this structure, a force is applied from the mat 5 to the filter 4 because the mat 5 attempts to return to its original shape before compression. As a result, the position of the filter 4 with respect to the filter case 3 is maintained. The mat 5 has the function of providing sealing between the filter case 3 and the filter 4 in addition to the above-described function of maintaining the position of the filter 4.

An annular retainer 6 (a restriction element) that restricts the movement of the filter 4 with respect to the filter case 3 and the mat 5 in the downstream direction is provided at a position downstream of the filter 4. The retainer 6 is fitted to the inner peripheral face 31D of the first case 31. The retainer 6 is arranged so as to be in contact with the filter 4.

The structure of the filter 4 will be described with reference to FIGS. 4A, 4B, 5A and 5B. The filter 4 is formed by integrally fitting the cylindrical filter body 41, a grid body 42 that is arranged in the filter body 41, and a first flange 45 and a second flange 46 that are provided on the outer peripheral face 41C of the filter body 41. The filter 41 is made of ceramic material. The grid body 42 is formed of a plurality of partition walls 43 that are arranged in a grid pattern. The partition walls 43 are formed as porous elements. A plurality of passages (cells 44), which are defined by the partition walls 43, is formed in the grid boy 42. Each partition wall 43 supports a catalyst (a NOx catalyst) that stores and reduces nitrogen oxide (NOx).

Multiple plugs 44C are provided, in the hound's tooth check pattern, at upstream-side openings (exhaust gas inlets 44A) of the grid body 42. Namely, the plugs 44C are arranged such that the exhaust gas inlets 44A of the cells 44 are alternately closed. In addition, other plugs 44C are provided, in the hound's tooth check pattern, at downstream-side openings (exhaust gas outlets 44B) of the grid body 42. Namely, the plugs 44C are arranged such that the exhaust gas outlets 44B of the cells 33 are alternately closed. In each cell 44, one of the exhaust gas inlet 44A and the exhaust gas outlet 44B is closed by the plug 44C. Thus, the exhaust gas that enters the filter 4 reliably passes through the partition walls 43 of the grid body 42. As a result, the filter 4 traps the PM with a higher degree of efficiency.

When the exhaust gas is passing through the partition walls 43, the PM in the exhaust gas is trapped in the partition walls 43. NOx in the exhaust gas is absorbed in the NOx catalyst when the air-fuel ratio of the exhaust gas is lean. The absorbed NOx is reduced to hydrocarbon (HC) and carbon monoxide (CO) when the air-fuel ratio of the exhaust gas is rich. The PM trapped in the partition walls 43 is oxidized by active oxygen that is produced when the NOx is absorbed. The PM trapped in the partition walls 43 may be oxidized by increasing the temperature of the filter 4.

Figure 6:
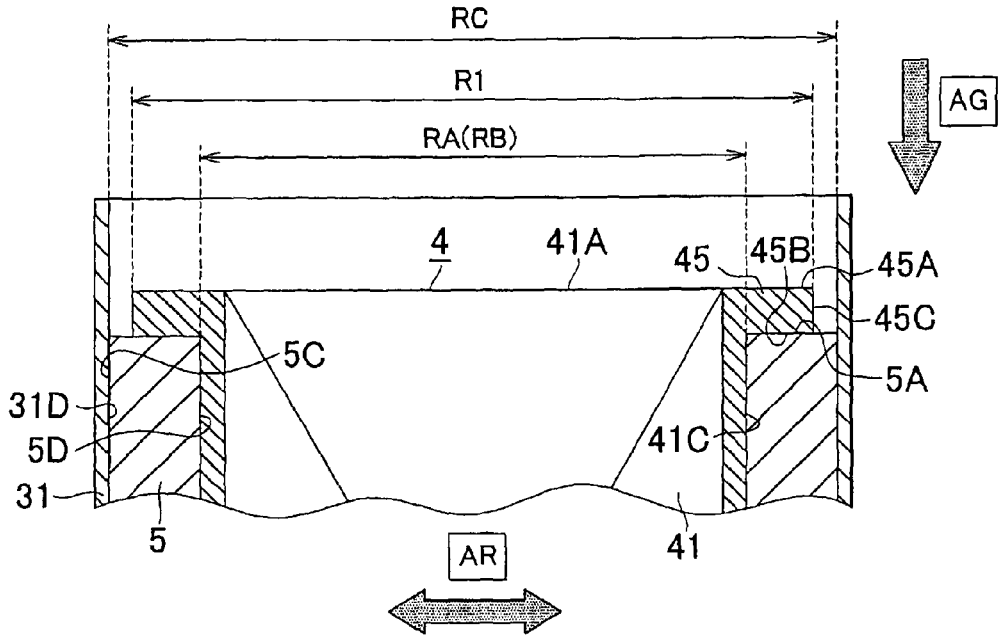
FIG. 6 is the cross-sectional view showing the structure of a portion of the filter included in the exhaust gas control apparatus for an engine according to the first embodiment of the invention, the portion being near a first flange.

The structure of the first flange 45 will be described with reference to FIG. 6. The first flange 45 is formed as an element (an assisting body) that is engaged with the mat 5 to restrict the movement of the filter 4 with respect to the filter case 3 and the mat 5. More specifically, the first flange 45 is provided on the outer peripheral face 41C of the filter body 41, at the upstream-side end of the filter body 41. The first flange 45 is formed integrally with the filter 41 and projects from the outer peripheral face 41C in the radial direction AR. The first flange 45 is formed such that an upstream-side end face 45A of the first flange 45 and an upstream-side end face 41A of the filter body 41 are in substantially the same plane. In addition, the first flange 45 is formed so as to be coaxial with the filter body 41. Further, the first flange 45 is formed such that an outer peripheral face 45C of the first flange 45 is positioned further outward than the outer peripheral face 41C of the filter body 41 (the inner peripheral face 5D of the mat 5) in the radial direction AR. Namely, an outer diameter of the first flange 45 (a flange outer diameter R1) is larger than each of an outer diameter of the filter 41 (a filter body outer diameter RA) and an inner diameter of the mat 5 (a mat inner diameter RB). The flange outer diameter R1 is smaller than an inner diameter of the first case 31 (a case inner diameter RC). In the exhaust gas control apparatus 2, the filter body outer diameter RA and the mat inner diameter RB are substantially equal to each other.

In the exhaust gas control apparatus 2, the filter 4 is arranged in the filter case 3 with a downstream-side end face 45B of the first flange 45 kept in contact with an upstream-side end face 5A of the mat 5. In other words, the filter 4 is arranged in the filter case 3 with the first flange 45 engaged with the mat 5. A clearance is left between the outer peripheral face 45C of the first flange 45 and the inner peripheral face 31D of the first case 31.

Figure 7:
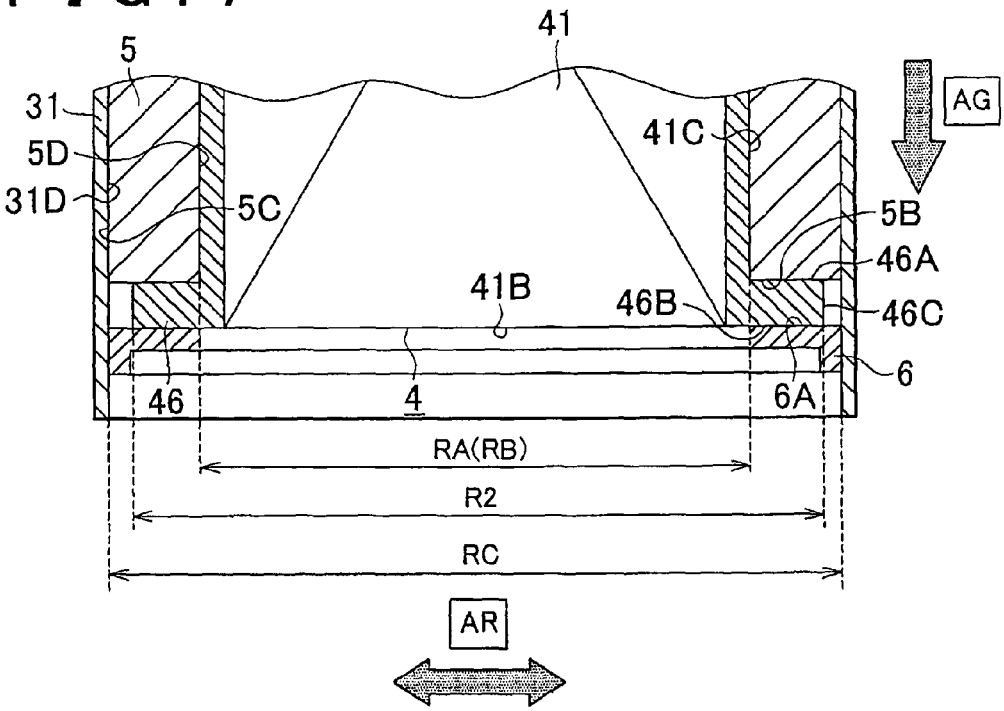
FIG. 7 is the cross-sectional view showing the structure of a portion of the filter included in the exhaust gas control apparatus for an engine according to the first embodiment of the invention, the portion being near a second flange.
Figure 8:
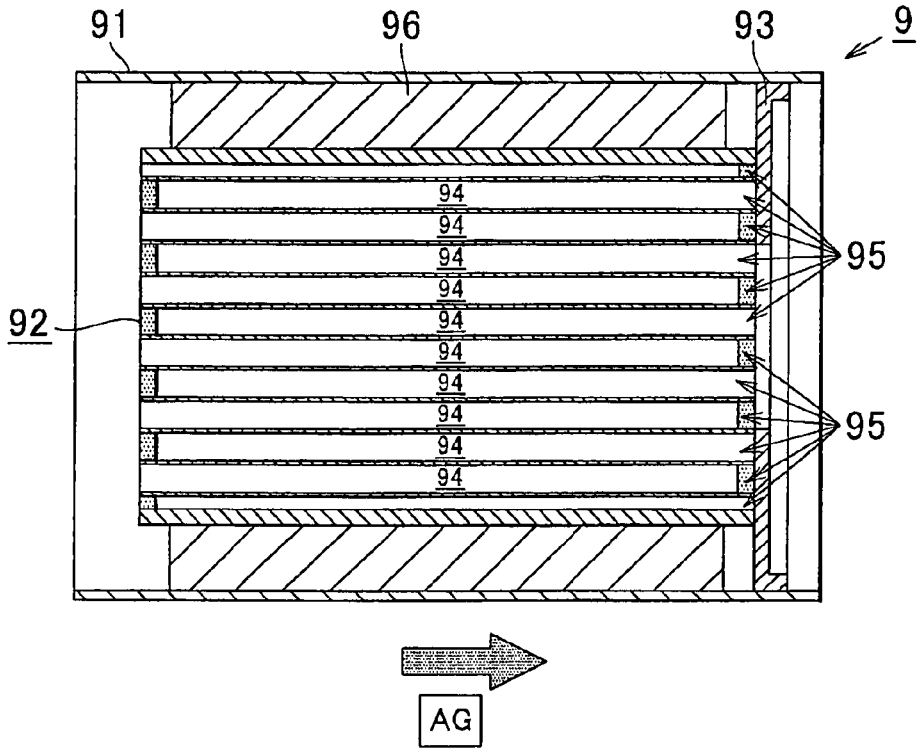
FIG. 8 RELATED ART
FIG. 8 is the cross-sectional view showing the cross-section structure of a virtual exhaust gas control apparatus that is implemented by applying a retainer to an exhaust gas control apparatus according to related art.

The structure of the second flange 46 will be described with reference to FIG. 7. The second flange 46 is formed as an element (an assisting body) that is engaged with the retainer 6 to restrict the movement of the filter 4 with respect to the filter case 3 and the mat 5. More specifically, the second flange 46 is provided on the outer peripheral face 41C, at the downstream-side end of the filter body 41. The second flange 46 is formed integrally with the filter 41, and projects from the outer peripheral face 41C in the radial direction AR. The second flange 46 is formed such that a downstream-side end face 46B of the second flange 46 and a downstream-side end face 41B of the filter body 41 are in substantially the same plane. In addition, the second flange 46 is formed so as to be coaxial with the filter body 41. Further, the second flange 46 is formed such that an outer peripheral face 46C of the second flange 46 is positioned further outward than the outer peripheral face 41C of the filter body 41 (the inner peripheral face 5D of the mat 5) in the radial direction AR. Namely, an outer diameter of the second flange 46 (a flange outer diameter R2) is larger than each of the filter body outer diameter RA and the mat inner diameter RB. Also, the flange outer diameter R2 is smaller than the case inner diameter RC.

In the exhaust gas control apparatus 2, the filter 4 is arranged in the filter case 3 with the second flange 46 engaged with the retainer 6, namely, with the downstream-side end face 46B of the second flange 46 kept in contact with an upstream-side end face 6A of the retainer 6. In other words, the filter 4 is arranged in the filter case 3 with the second flange 46 engaged with the retainer 6. The mat 5 is wrapped around the filter 4 with an upstream-side end face 46A of the second flange 46 kept in contact with a downstream-side end face 5B of the mat 5. A clearance is left between the outer peripheral face 46C of the second flange 46 and the inner peripheral face 31D of the first case 31. The upstream-side end face 6A of the retainer 6 is in contact with the downstream-side end face 46B of the second flange 46 but is not in contact with the filter body 41 (a portion of the filter 4, in which the cells 44 are formed).

Effects of the First Embodiment of the Invention

As described above in detail, the exhaust gas control apparatus 2 for an engine according to the first embodiment of the invention produces the following effects.

(1) In the exhaust gas control apparatus 2 according to the first embodiment of the invention, the filter 4 is arranged in the filter case 3 with the second flange 46 of the filter 4 engaged with the retainer 6. With this structure, the movement of the filter 4 with respect to the filter case 3 and the mat 5 in the downstream direction is restricted. As a result, it is possible to suppress contact between the filter case 3 and the filter 4.

(2) In an exhaust gas control apparatus according to related art (for example, an exhaust gas control apparatus described in JP-A-2001-289028), the filter is maintained at a predetermined position only by an elastic force of a mat. Accordingly, if the pressure of the exhaust gas is excessively increased by, for example, accumulation of a great amount of PM in a filter, the filter moves with respect to a filter case. In contrast, the exhaust gas control apparatus 2 according to the first embodiment of the invention has the structure in which the filter 4 is supported from the downstream side by the retainer 6 and the retainer is fitted to the filter case 3. Accordingly, even if the pressure of the exhaust gas is excessively increased as described above, it is possible to appropriately suppress the movement of the filter 4 with respect to the filter case 3 and the mat 5.

(3) In the exhaust gas control apparatus 2 according to the first embodiment of the invention, the filter 4 is arranged in the filter case 3 with the upstream-side end face 6A of the retainer 6 kept in contact with the downstream-side end face 46B of the second flange 46. Accordingly, the following effects are produced. The effects will be described based on the comparison between the exhaust gas control apparatus 2 according to the first embodiment of the invention and a virtual exhaust gas control apparatus 9, shown in FIG. 8, that is implemented by applying a retainer 93 to the exhaust gas control apparatus described in JP-A-2001-289028. The exhaust gas control apparatus 9 differs from the exhaust gas control apparatus 2 according to the first embodiment of the invention in that the filter 92 is not provided with a flange.

Figure 9:
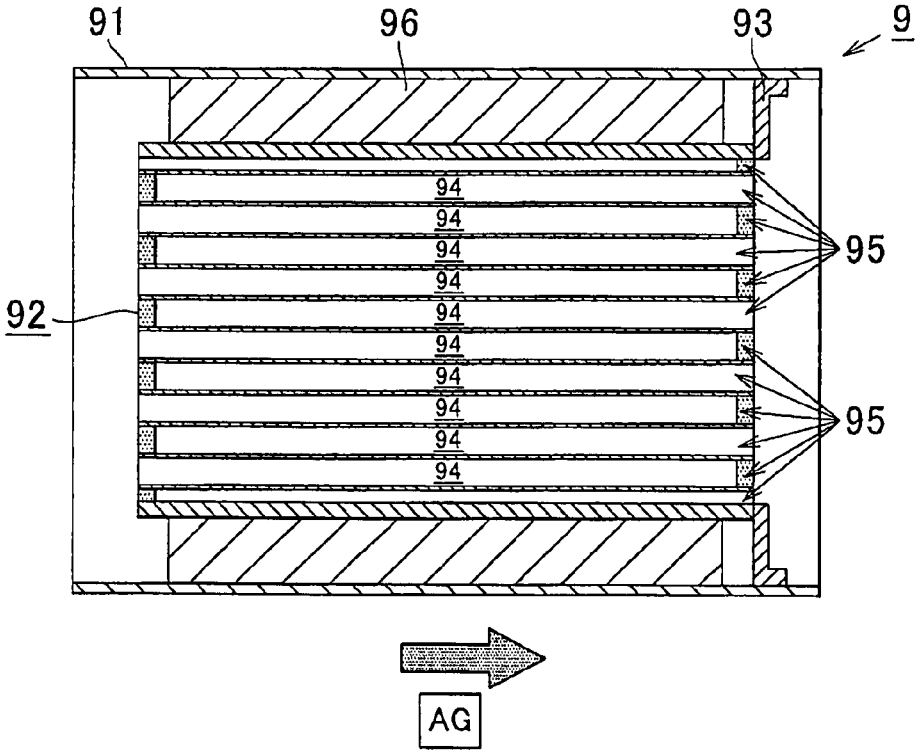
FIG. 9 RELATED ART
FIG. 9 is the cross-sectional view showing the cross-section structure of a virtual exhaust gas control apparatus that is implemented by applying a retainer to an exhaust gas control apparatus according to related art.

In the exhaust gas control apparatus 9, although the movement of a filter 92 with respect to a filter case 91 is restricted by the retainer 93, the retainer 93 blocks some of exhaust gas outlets 95 of cells 94, which increases the pressure of the exhaust gas. In order to effectively restrict the movement of the filter 92 using the retainer 93 while suppressing an increase in the pressure of the exhaust gas, the area at which the retainer 93 contacts the filter 92 may be decreased to minimize the area in which the exhaust gas outlets 95 are blocked by the retainer 93, as shown in FIG. 9. In this case, because the pressure applied to the portion of the filter 92, which contacts the retainer 93, is increased due to a decrease in the contact area, chipping or cracking may occur due to an increase in the pressure applied to a local area of the filter 92.

Even when the filter 92 is made of materials other than ceramic, the filter may be partially deformed. Alternatively, the outer diameter of the filter 92 may be set to a great value with the area, in which the exhaust gas outlets 95 of the cells 94 will be blocked by the retainer 93, taken into account. In this way, an appropriate passage area of the exhaust passage may be obtained even if the retainer 93 is provided. In this case, however, the following inconveniences may be caused. The entire size of the exhaust gas control apparatus 9 may be increased, because the size of the filter case 91 increases as the outer diameter of the filter 92 increases. In addition, because the size of a mat 96 that are wrapped around the filter 92 increases, a production cost may increase.

In contrast to the virtual exhaust gas control apparatus 9, in the exhaust gas control apparatus 2 according to the first embodiment of the invention, the second flange 46 is engaged with the retainer 6 but the filter body 41 is not in contact with the retainer 6. As a result, the retainer 6 does not block the exhaust gas outlets 44B of the cells 44. With this structure, it is possible to suppress an increase in the pressure of the exhaust gas due to blockage of the cells 44 caused by the retainer 6. As a result, the fuel efficiency of the engine 1 improves. Also, a sufficient area at which the second flange 46 is in contact with the retainer 6 is obtained by making the second flange 46 in contact with the retainer 6. With this structure, it is possible to suppress occurrence of chipping and cracking in the filter 4. The outer diameter of the filter body 41 may be substantially equal to that in the related art. Therefore, it is possible to suppress a cost increase due to increases in the sizes of the exhaust gas control apparatus 2 and the mat 5.

(4) In the exhaust gas control apparatus 2 according to the first embodiment of the invention, the filter 4 is arranged with the downstream-side end face 45B of the first flange 45 kept in contact with the upstream-side end face 5A of the mat 5. Thus, the movement of the filter 4 with respect to the filter case 3 and the mat 5 is restricted by the first flange 45 in addition to the retainer 6. As a result, it is possible to more appropriately suppress contact between the filter case 3 and the filter 4.

(5) The first flange 45 is engaged with the mat 5. Accordingly, even if the pressure of the exhaust gas is excessively increased as described above in (2), it is possible to more reliably restrict the movement of the filter 4 with respect to the filter case 3 and the mat 5.

(6) In addition, because the first flange 45 is engaged with the mat 5, the pressure applied to the second flange 46 is decreased. As a result, it is possible to suppress occurrence of chipping and cracking in the second flange 46 due to contact between the second flange 46 and the retainer 6.

(7) Because the first flange 45 is arranged at a position upstream of the upstream-side end face 5A of the mat 5, the upstream-side end face 5A is less likely to be exposed to the exhaust gas. As a result, it is possible to suppress degradation of the mat 5. In the exhaust gas control apparatus 2, if the upstream-side end face 5A is exposed to the exhaust gas, the fibers forming the mat 5 may come out of the upstream-side end face 5A and be carried away with the exhaust gas.

(8) In the exhaust gas control apparatus 2 according to the first embodiment of the invention, the flange outer diameter R1 is set such that a clearance is left between the outer peripheral face 45C of the first flange 45 and the inner peripheral face 31D of the first case 31. Thus, it is possible to suppress occurrence of chipping and cracking in the first flange 45 due to contact between the first case 31 and the first flange 45.

(9) In the exhaust gas control apparatus 2 according to the first embodiment of the invention, the flange outer diameter R2 is set such that a clearance is left between the outer peripheral face 46C of the second flange 46 and the inner peripheral face 31D of the first case 31. Thus, it is possible to suppress occurrence of chipping and cracking in the second flange 46 due to contact between the first case 31 and the second flange 46.

Second Embodiment of the Invention

Figure 10:
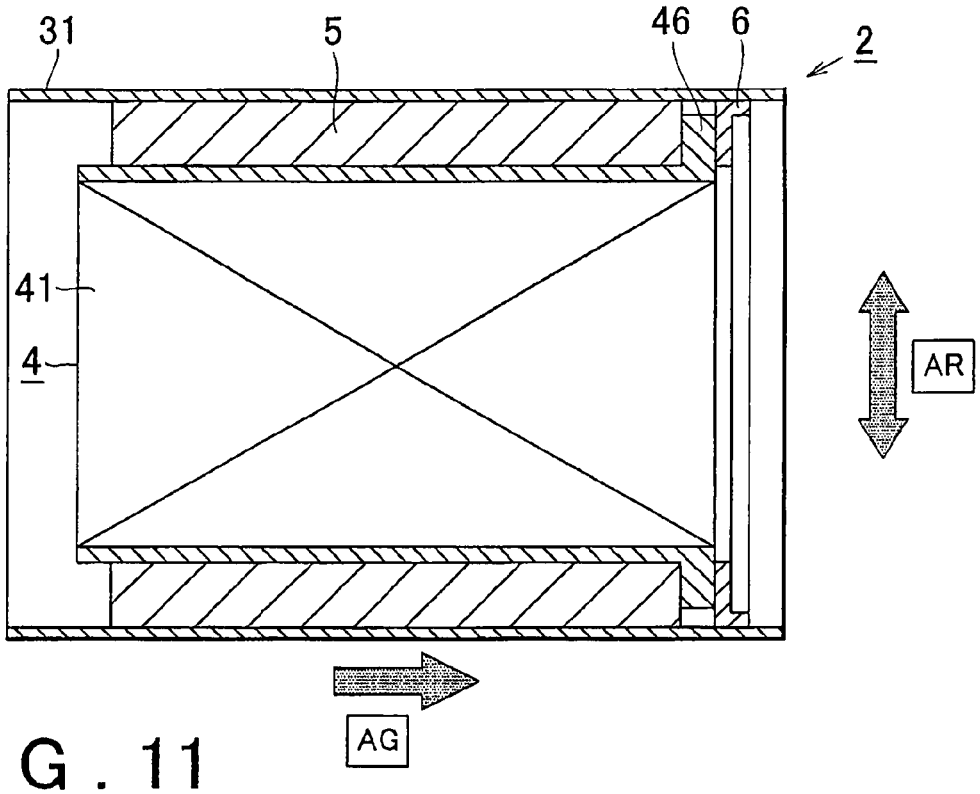
FIG. 10 is the cross-sectional view showing the cross-section structure of an exhaust gas control apparatus for an engine according to a second embodiment of the invention.

A second embodiment of the invention will be described with reference to FIG. 10. In the exhaust gas control apparatus 2 according to the first embodiment of the invention, the movement of the filter 4 with respect to the filter case 3 and the mat 5 is restricted by an elastic force of the mat 5, engagement of the second flange 46 with the retainer 6, and engagement of the first flange 45 with the mat 5. In contrast, in an exhaust gas control apparatus 2 according to the second embodiment of the invention, the first flange 45 is not provided, and the movement of the filter 4 is restricted by an elastic force of the mat 5 and engagement of the second flange 46 with the retainer 6. Namely, as shown in FIG. 10, only the second flange 46 is provided on the filter 4 as an assisting body. The exhaust gas control apparatus 2 according to the second embodiment of the invention is mostly the same as the exhaust gas control apparatus 2 according to the first embodiment of the invention except that the first flange 45 is not provided in the exhaust gas control apparatus 2 according to the second embodiment of the invention.

Effects of the Second Embodiment of the Invention

As described above in detail, the exhaust gas control apparatus 2 for an engine according to the second embodiment of the invention produces the effects (1) to (3) and (9) described in the first embodiment of the invention.

Third Embodiment of the Invention

Figure 11:
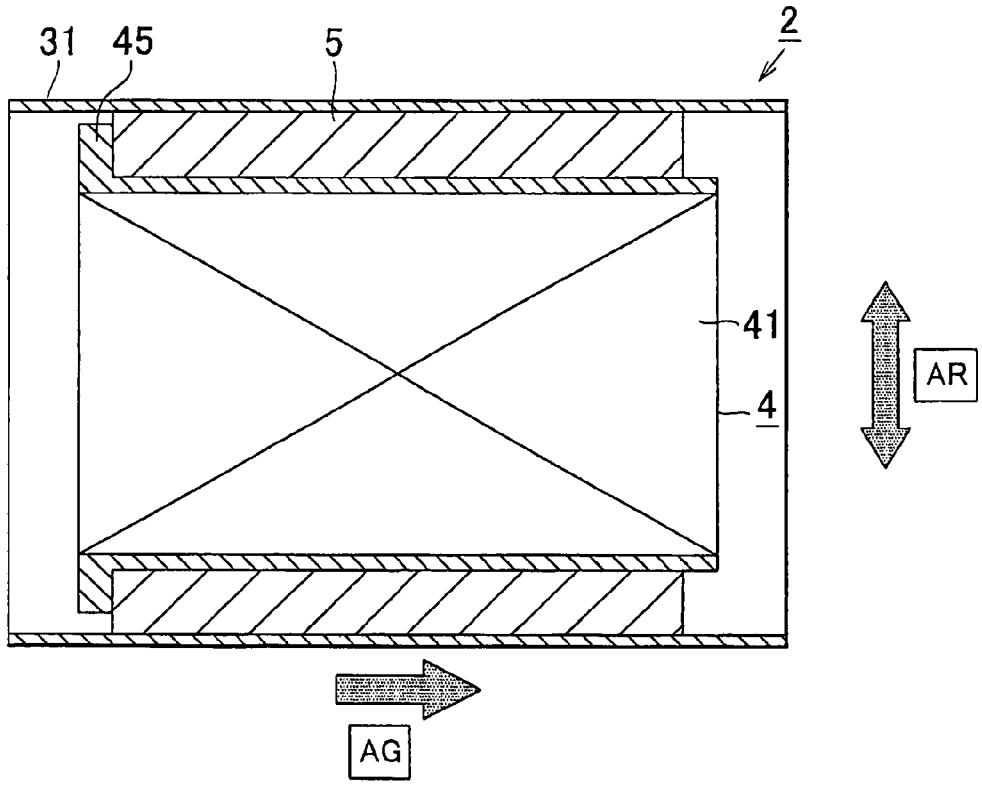
FIG. 11 is the cross-sectional view showing the cross-section structure of an exhaust gas control apparatus for an engine according to a third embodiment of the invention.

A third embodiment of the invention will be described with reference to FIG. 11. In the exhaust gas control apparatus 2 according to the first embodiment of the invention, the movement of the filter 4 with respect to the filter case 3 and the mat 5 is restricted by an elastic force of the mat 5, engagement of the second flange 46 with the retainer 6, and engagement of the first flange 45 with the mat 5. In contrast, in an exhaust gas control apparatus 2 according to the third embodiment of the invention, the second flange 46 and the retainer 6 are not provided, and the movement of the filter 4 is restricted by an elastic force of the mat 5 and engagement of the first flange 45 with the mat 5. Namely, as shown in FIG. 11, only the first flange 45 is provided on the filter 4, as an assisting body. The exhaust gas control apparatus 2 according to the third embodiment of the invention is mostly the same as the exhaust gas control apparatus 2 according to the first embodiment of the invention except that the second flange 46 and the retainer 6 are not provided in the exhaust gas control apparatus 2 according to the third embodiment of the invention.

Effects of the Third Embodiment of the Invention

As described above in detail, the exhaust gas control apparatus 2 according to the third embodiment of the invention produces the following effects in addition to the effects (4) to (8) described in the first embodiment.

(10) In the exhaust gas control apparatus 2 according to the third embodiment of the invention, the exhaust gas outlets 44B of the cells 44 are not blocked by the retainer 6. Accordingly, it is possible to suppress an increase in the pressure of the exhaust gas due to blockage of the cells 44. In addition, it is possible to improve the fuel efficiency of the engine 1.

(11) Also, the outer diameter of the filter body 41 may be substantially equal to that in the related art. Accordingly, it is possible to suppress a cost increase due to increases in the sizes of the exhaust gas control apparatus 2 and the mat 5.

Fourth Embodiment of the Invention

Figure 12:
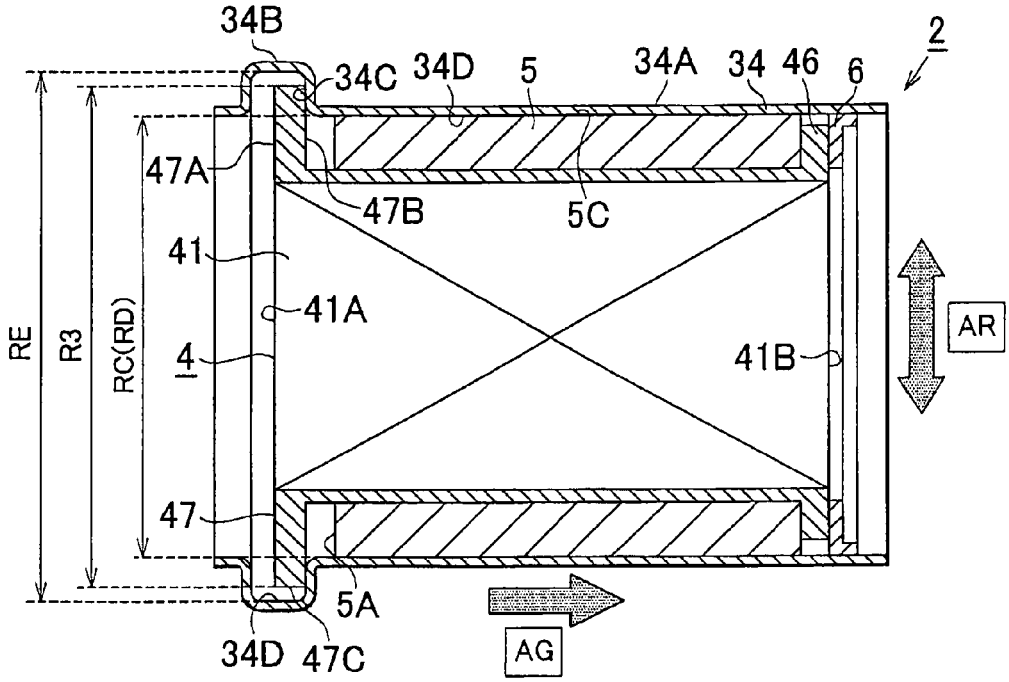
FIG. 12 is the cross-sectional view showing the cross-section structure of an exhaust gas control apparatus for an engine according to a fourth embodiment of the invention.

A fourth embodiment of the invention will be described with reference to FIG. 12. The exhaust gas control apparatus 2 according to the first embodiment of the invention is structured such that the movement of the filter 4 with respect to the filter case 3 and the mat 5 is restricted by the factors including engagement of the first flange 45 with the mat 5. In contrast, in an exhaust gas control apparatus 2 according to the fourth embodiment of the invention, the movement of the filter 4 is restricted by the factors including engagement of a third flange 47, which is used instead of the first flange 45, with a fourth case 34, which is used instead of the first case 31. The exhaust gas control apparatus 2 according to the fourth embodiment of the invention is mostly the same as the exhaust gas control apparatus 2 according to the first embodiment of the invention except for the following points.

The structure of the fourth case 34 and the third flange 47 will be described with reference to FIG. 12. The fourth case 34 includes a small-diameter portion 34A having the inner diameter appropriate for the outer diameter of the filter body 41 (the filter body outer diameter RA); and a large-diameter portion 34B having the inner diameter appropriate for the outer diameter of the third flange 47 (a flange outer diameter R3).

The third flange 47 is formed as an element (an assisting body) that is engaged with the fourth case 34 to restrict the movement of the filter 4 with respect to the filter case 3 and the mat 5 in the downstream direction. More specifically, the third flange 47 is provided on the outer peripheral face 41C, at the upstream-side end of the filter body 41. The third flange 47 is formed integrally with the filter body 41, and projects in the radial direction AR. The third flange 47 is formed such that an upstream-side end face 47A of the third flange 47 and the upstream-side end face 41A of the filter body 41 are in substantially the same plane. In addition, the third flange 47 is formed so as to be coaxial with the filter body 41. Further, the third flange 47 is formed such that an outer peripheral face 47C of the third flange 47 is positioned further outward than an inner peripheral face 34D of the small-diameter portion 34A (the outer peripheral face 5C of the mat 5) in the radial direction AR. Namely, the flange outer diameter R3 is larger than each of the inner diameter of the small-diameter portion 34A (the case inner diameter RC) and the outer diameter of the mat 5 (a mat outer diameter RD). The flange outer diameter R3 is smaller than the inner diameter of the large-diameter portion 34B (a large-diameter portion inner diameter RE). In the exhaust gas control apparatus 2, the case inner diameter RC and the mat outer diameter RD are substantially equal to each other.

In the exhaust gas control apparatus 2, the filter 4 is arranged in the filter case 3 with the third flange 47 engaged with the fourth case 34, namely, with a downstream-side end face 47B of the third flange 47 kept in contact with a downstream-side end face 34C of the large-diameter portion 34B. In other words, the filter 4 is arranged in the filter case 3 with the third flange 47 engaged with the fourth case 34. A clearance is left between the downstream-side end face 47B of the third flange 47 and the upstream-side end face 5A of the mat 5. In addition, a clearance is left between the outer peripheral face 47C of the third flange 47 and the inner peripheral face 34D of the large-diameter portion 34B. In the fourth embodiment of the invention, the structure in which a clearance is left between the downstream-side end face 47B of the third flange 47 and the upstream-side end face 5A of the mat 5 is employed. Instead of this structure, the structure in which the downstream-side end face 47B is in contact with the upstream-side end face 5A may be employed.

Effects of the Fourth Embodiment of the Invention

As described above in detail, the exhaust gas control apparatus 2 for an engine according to the fourth embodiment of the invention produces the effects (1) to (7) described in the first embodiment of the invention.

Fifth Embodiment of the Invention

Figure 13:
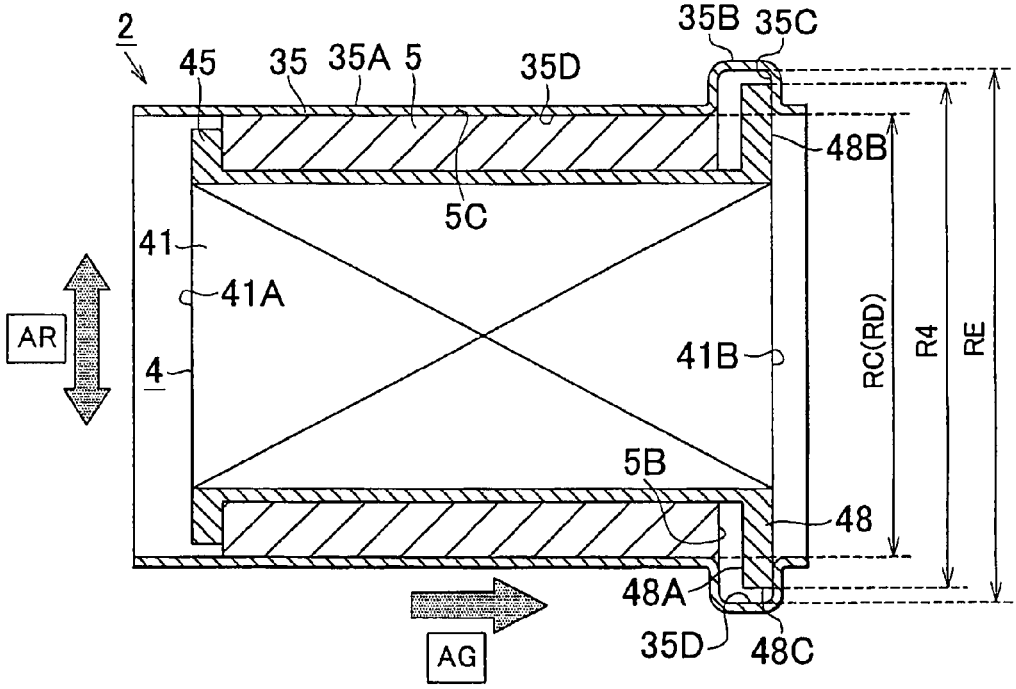
FIG. 13 is the cross-sectional view showing the cross-section structure of an exhaust gas control apparatus for an engine according to a fifth embodiment of the invention.

A fifth embodiment of the invention will be described with reference to FIG. 13. In the exhaust gas control apparatus 2 according to the first embodiment of the invention, the movement of the filter 4 with respect to the filter case 3 and the mat 5 is restricted by the factors including engagement of the second flange 46 with the retainer 6. In contrast, in an exhaust gas control apparatus 2 according to the fifth embodiment of the invention, the movement of the filter 4 is restricted by the factors including engagement of a fourth flange 48, which is used instead of the second flange 46, with a fifth case 35, which is used instead of the first case 31. The exhaust gas control apparatus 2 according to the fifth embodiment of the invention is mostly the same as the exhaust gas control apparatus 2 according to the first embodiment of the invention except that the retainer 6 is not provided in the exhaust gas control apparatus 2 according to the fifth embodiment and the following changes are made.

The structure of the fifth case 35 and the fourth flange 48 will be described with reference to FIG. 13. The fifth case 35 includes a small-diameter portion 35A having the inner diameter appropriate for the outer diameter of the filter body 41 (the filter body outer diameter RA) and a large-diameter portion 35B having the inner diameter appropriate for the outer diameter of the fourth flange 48 (a flange outer diameter R4).

The fourth flange 48 is formed as an element (an assisting body) that is engaged with the fifth case 35 to restrict the movement of the filter 4 with respect to the filter case 3 and the mat 5 in the downstream direction. More specifically, the fourth flange 48 is provided on the outer peripheral face 41C of the filter body 41, at the downstream-side end of the filter body 41. Also, the fourth flange 48 is formed integrally with the filter body 41, and projects from the outer peripheral face 41C in the radial direction AR. The fourth flange 48 is formed such that a downstream-side end face 48B of the fourth flange 48 and the downstream-side end face 41B of the filter body 41 are in substantially the same plane. The fourth flange 48 is formed so as to be coaxial with the filter body 41. Also, the fourth flange 48 is formed such that an outer peripheral face 48C of the fourth flange 48 is positioned further outward than an inner peripheral face 35D of the small-diameter portion 35A (the outer peripheral face 5C of the mat 5) in the radial direction AR. Namely, the flange outer diameter R4 is larger than each of the case inner diameter RC and the mat outer diameter RD. Also, the flange outer diameter R4 is smaller than the inner diameter of the large-diameter portion 35B (the large-diameter portion inner diameter RE).

In the exhaust gas control apparatus 2, the filter 4 is arranged in the filter case 3 with the fourth flange 48 engaged with the fifth case 35, namely, with the downstream-side end face 48B of the fourth flange 48 kept in contact with a downstream-side end face 35C of the large-diameter portion 35B. In other words, the filter 4 is arranged in the filter case 3 with the fourth flange 48 engaged with the fifth case 35. A clearance is left between an upstream-side end face 48A of the fourth flange 48 and the downstream-side end face 5B of the mat 5. Also, a clearance is left between the outer peripheral face 48C of the fourth flange 48 and the inner peripheral face 35D of the large-diameter portion 35B. The downstream-side end face 35C of the large-diameter portion 35B is in contact with the downstream-side end face 48B of the fourth flange 48 but is not in contact with the filter body 41 (the portion of the filter 4, in which the cells 44 are formed). In the fifth embodiment of the invention, the structure in which a clearance is left between the upstream-side end face 48A of the fourth flange 48 and the downstream-side end face 5B of the mat 5 is employed. Instead of this structure, the structure in which the upstream-side end face 48A is in contact with the downstream-side end face 5B may be employed.

Effects of the Fifth Embodiment of the Invention

As described above in detail, the exhaust gas control apparatus 2 for an engine according to the fifth embodiment of the invention produces the above-described effects (1) to (9) in the first embodiment of the invention.

Sixth Embodiment of the Invention

A sixth embodiment of the invention will be described with reference to FIGS. 14 and 15. In the exhaust gas control apparatus 2 according to the first embodiment of the invention, the movement of the filter 4 with respect to the filter case 3 and the mat 5 is restricted by an elastic force of the mat 5, engagement of the second flange 46 with the retainer 6, and engagement of the first flange 45 with the mat 5. In contrast, in the exhaust gas control apparatus 2 according to the sixth embodiment of the invention, the second flange 46 and the retainer 6 are not provided, and the movement of the filter 4 is restricted basically by an elastic force of the mat 5. When the filter 4 moves with respect to the filter case 3 and the mat 5 due to an excessively high pressure applied to the filter 4, the first flange 45 is engaged with the mat 5, whereby the movement of the filter 4 is restricted. The exhaust gas control apparatus 2 according to the sixth embodiment of the invention is mostly the same as the exhaust gas control apparatus 2 according to the first embodiment of the invention except that the second flange 46 and the retainer 6 are not provided in the exhaust gas control apparatus 2 according to the sixth embodiment and the following changes are made.

Figure 14:
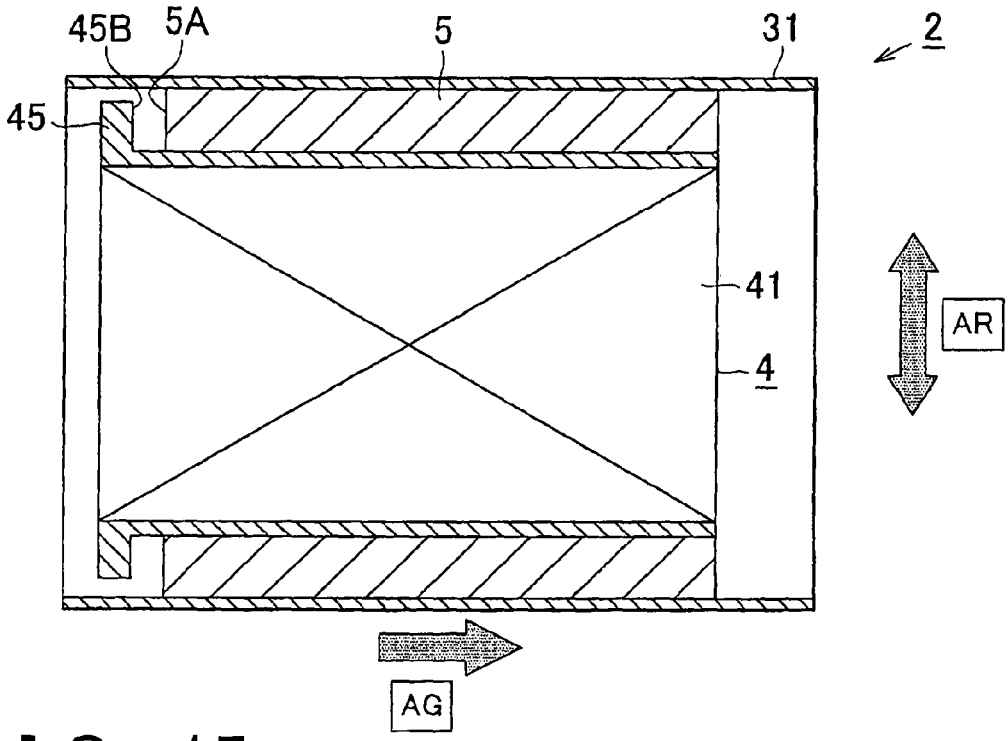
FIG. 14 is the cross-sectional view showing the cross-section structure of an exhaust gas control apparatus for an engine according to a sixth embodiment of the invention.
Figure 15:
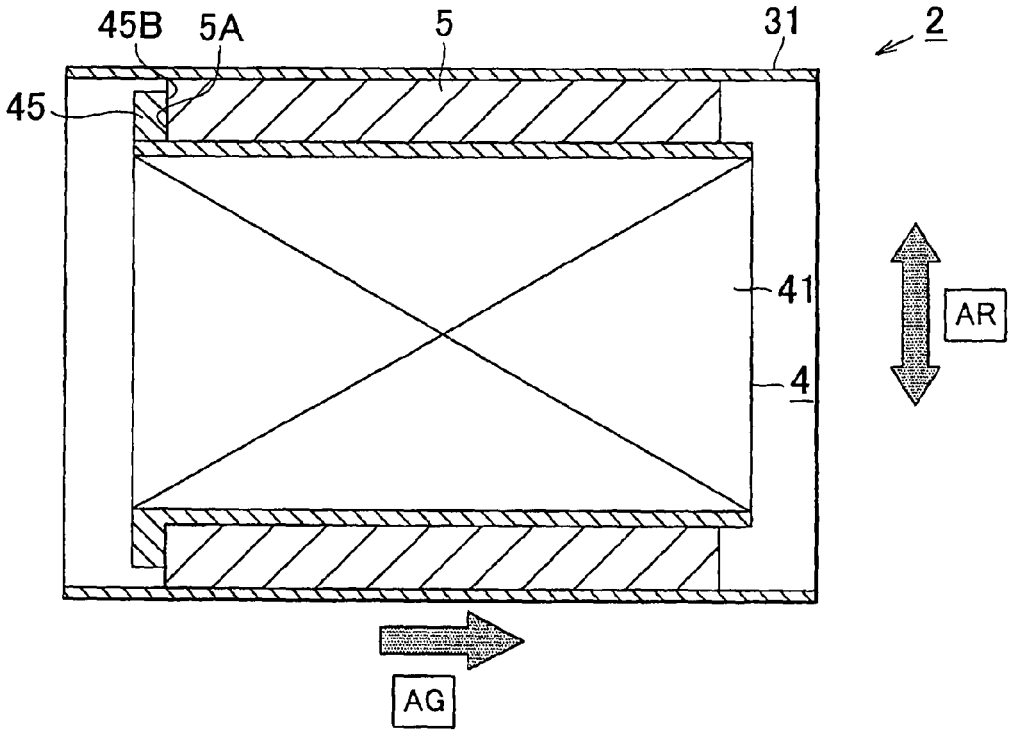
FIG. 15 is the cross-sectional view of the exhaust gas control apparatus according to the sixth embodiment of the invention, which illustrates the state where the filter has been moved.

As shown in FIG. 14, in the exhaust gas control apparatus 2, the filter 4 is arranged in the filter case 3 such that the first flange 45 is not engaged with the mat 5, namely, with a clearance left between the downstream-side end face 45B of the first flange 45 and the upstream-side end face 5A of the mat 5. The downstream-side end face 45B of the first flange 45 and the upstream-side end face 5A of the mat 5 face each other with a clearance left therebetween. With this structure, when the filter 4 moves with respect to the filter case 3 in the downstream direction, the first flange 45 of the filter 4 is engaged with the mat 5, as shown in FIG. 15, namely, the downstream-side end face 45B of the first flange 45 comes in contact with the upstream-side end face 5A of the mat 5. Accordingly, even if the filter 4 moves with respect to the filter case 3 and the mat 5 due to an excessively high pressure applied to the filter 4, the movement of the filter 4 is restricted by engagement of the first flange 45 with the mat 5. The amount of clearance between the first flange 45 and the mat 5 is set such that, when the filter 4 moves with respect to the filter case 3 and the mat 5 in the downstream direction, the first flange 45 is engaged with the mat 5 before the filter 4 comes into contact with the filter case 3.

Effects of the Sixth Embodiment of the Invention

As described above in detail, the exhaust gas control apparatus 2 for an engine according to the sixth embodiment of the invention produces the following effects.

(1) In the exhaust gas control apparatus 2 according to the sixth embodiment of the invention, the filter 4 is arranged in the filter case 3 such that the downstream-side end face 45B of the first flange 45 faces the upstream-side end face 5A of the mat 5 with a clearance left therebetween. With this structure, when the filter 4 moves with respect to the filter case 3 and the mat 5, the movement of the filter 4 is restricted by engagement of the first flange 45 with the mat 5. Accordingly, it is possible to suppress contact between the filter case 3 and the filter 4, which is caused by the movement of the filter 4.

(2) Also, it is possible to suppress occurrence of chipping and cracking in the filter 4, which is caused by contact between the filter 4 and the filter case 3. (3) In addition, because the first flange 45 is arranged at a position upstream of the upstream-side end face 5A of the mat 5, the upstream-side end face 5A is less likely to be exposed to the exhaust gas. As a result, it is possible to suppress degradation of the mat 5.

(4) In the exhaust gas control apparatus 2 according to the sixth embodiment of the invention, the flange outer diameter R1 is set such that a clearance is left between the outer peripheral face 45C of the first flange 45 and the inner peripheral face 31D of the first case 31. Thus, it is possible to suppress occurrence of chipping and cracking in the first flange 45, which is caused by contact between the first case 31 and the first flange 45.

Seventh Embodiment of the Invention

A seventh embodiment of the invention will be described with reference to FIGS. 16 and 17. In the exhaust gas control apparatus 2 according to the first embodiment of the invention, the movement of the filter 4 with respect to the filter case 3 and the mat 5 is restricted by an elastic force of the mat 5, engagement of the second flange 46 with the retainer 6, and engagement of the first flange 45 with the mat 5. In contrast, in an exhaust gas control apparatus 2 according to the seventh embodiment of the invention, the movement of the filter 4 is restricted basically by an elastic force of the mat 5. When the filter 4 moves with respect to the filter case 3 and the mat 5 due to an excessively high pressure applied to the filter 4, a shock-absorbing member 36 and the filter 4 are brought into contact with each other, whereby contact between the filter case 3 and the filter 4 is suppressed. The exhaust gas control apparatus according to the seventh embodiment of the invention is mostly the same as the exhaust gas control apparatus according to the first embodiment of the invention except that the first flange 45 and the retainer 6 are not provided in the exhaust gas control apparatus 2 according to the seventh embodiment and the following changes are made.

Figure 16:
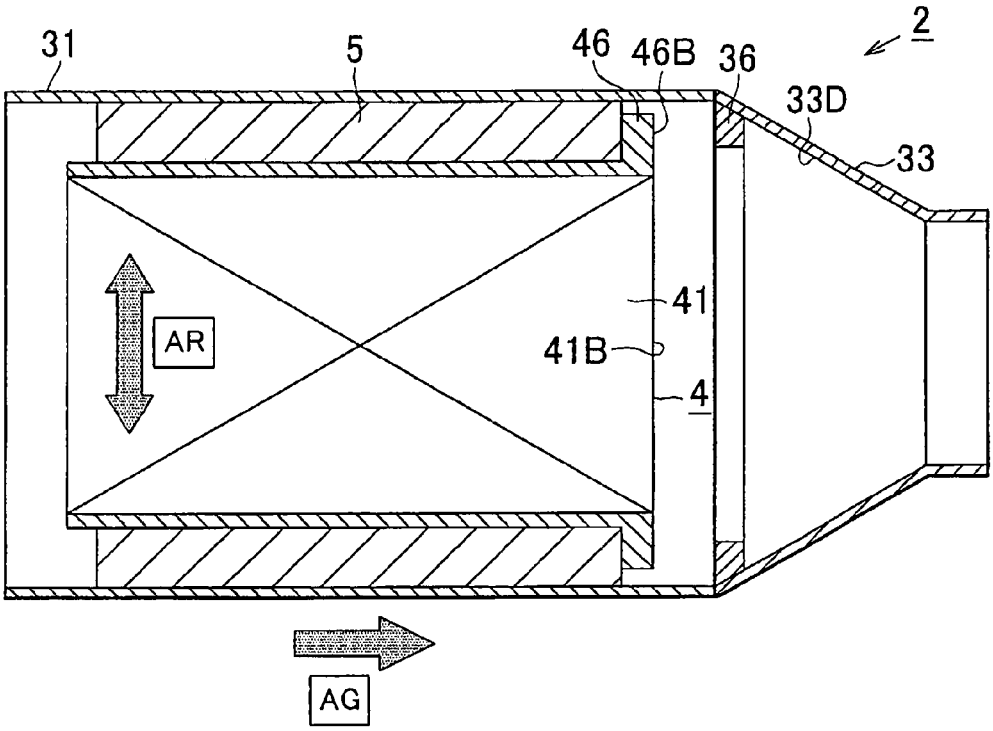
FIG. 16 is the cross-sectional view showing the cross-section structure of an exhaust gas control apparatus for an engine according to a seventh embodiment of the invention.
Figure 17:
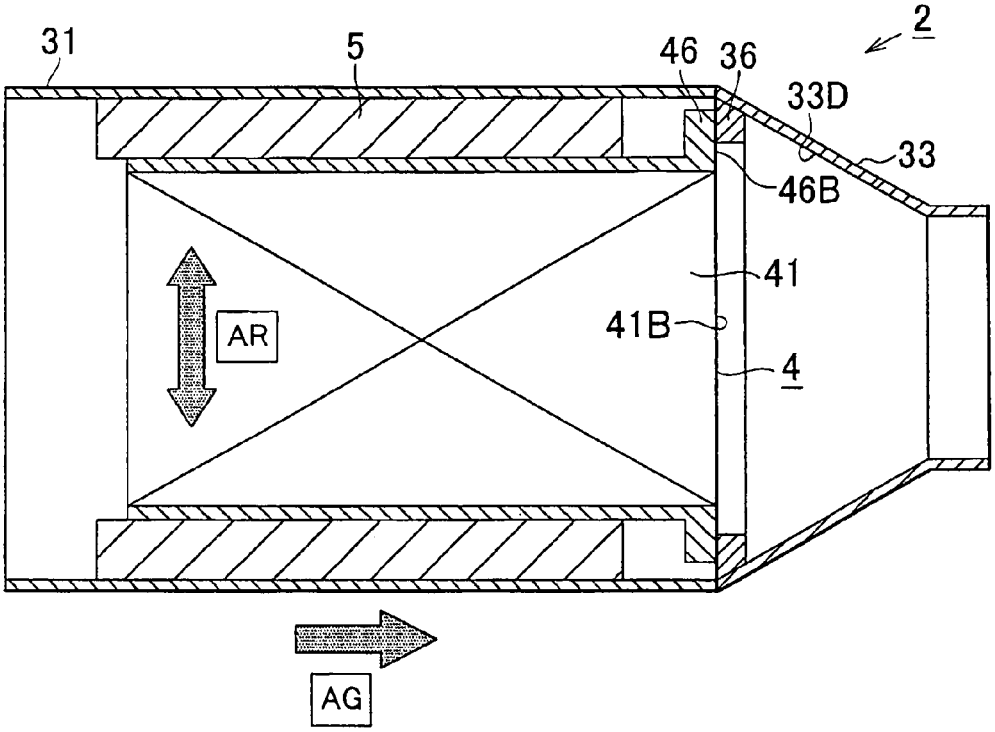
FIG. 17 is the cross-sectional view of the exhaust gas control apparatus according to the seventh embodiment of the invention, which illustrates the state where the filter has been moved.

As shown in FIG. 16, in the exhaust gas control apparatus 2, the shock-absorbing member 36 is provided on an inner peripheral face 33D of the third case 33 that faces the downstream-side end face 46B of the second flange 46. Thus, when the filter 4 moves with respect to the filter case 3 and the mat 5 in the downstream direction, the second flange 46 of the filter 4 and the shock-absorbing member 36 come into contact with each other, as shown in FIG. 17. Accordingly, even if the filter 4 moves with respect to the filter case 3 and the mat 5 due to an excessively high pressure applied to the filter 4, contact between the filter case 3 and the filter 4 is suppressed. In the exhaust gas control apparatus 2, the positional relationship between the filter 4 and the shock-absorbing member 36 is set such that the shock absorbing member 36 does not come into contact with the filter body 41 when the second flange 46 contacts the shock-absorbing member 36.

Effects of the Seventh Embodiment of the Invention

As described above in detail, the exhaust gas control apparatus 2 for an engine according to the seventh embodiment of the invention produces the following effects.

(1) In the exhaust gas control apparatus 2 according to the seventh embodiment of the invention, the shock-absorbing member 36 is provided on the inner peripheral face 33D of the third case 33 that faces the downstream-side end face 46B of the second flange 46. Accordingly, it is possible to suppress contact between the filter case 3 and the filter 4, which is caused by the movement of the filter 4.

(2) In addition, when the filter 4 comes into contact with the shock-absorbing member 36, the cells 44 are not blocked by the shock-absorbing member 36. Accordingly, it is possible to suppress an increase in the pressure of the exhaust gas. Also, it is possible to suppress reduction in the fuel efficiency of the engine 1.

Eighth Embodiment of the Invention

An eighth embodiment of the invention will be described with reference to FIGS. 18 and 19. In the exhaust gas control apparatus 2 according to the first embodiment of the invention, the movement of the filter 4 with respect to the filter case 3 and the mat 5 is restricted by an elastic force of the mat 5 engagement of the second flange 46 with the retainer 6, and engagement of the first flange 45 with the mat 5. In contrast, in the exhaust gas control apparatus 2 according to the eighth embodiment of the invention, the movement of the filter 4 is restricted basically by an elastic force of the mat 5. When the filter 4 moves with respect to the filter case 3 and the mat 5 due to an excessively high pressure applied to the filter 4, the shock-absorbing member 36 provided to the filter 4 and the filter case 3 are brought into contact with each other, whereby contact between the filter case 3 and the filter 4 is suppressed. The exhaust gas control apparatus 2 according to the eighth embodiment of the invention is mostly the same as the exhaust gas control apparatus 2 according to the first embodiment of the invention except that the first flange 45 and the retainer 6 are not provided in the exhaust gas control apparatus 2 according the eighth embodiment.

Figure 18:
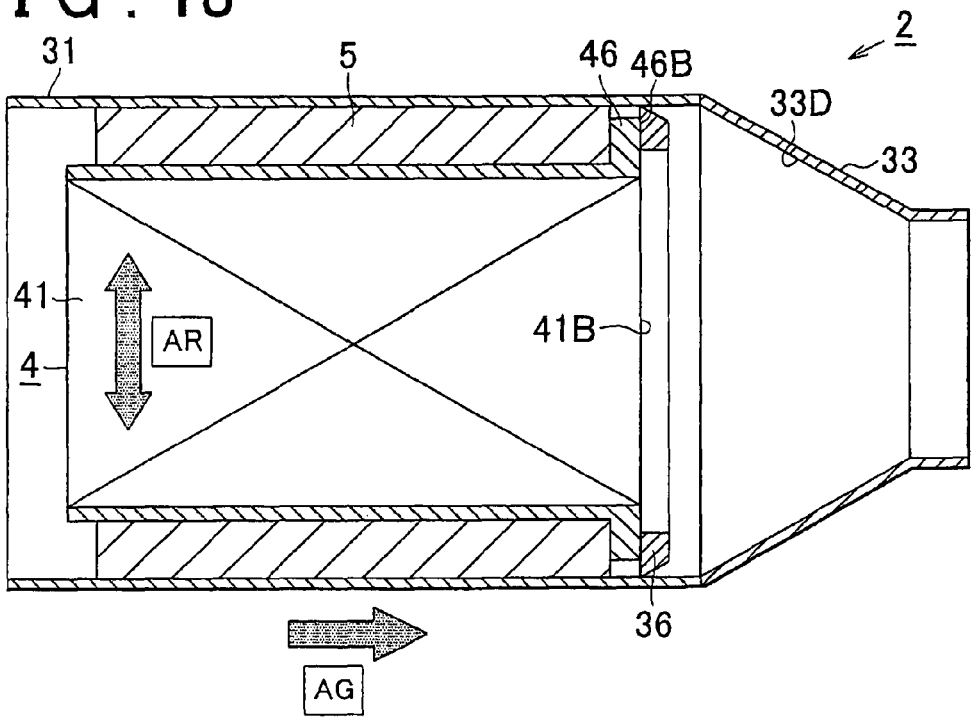
FIG. 18 is the cross-sectional view showing the cross-section structure of an exhaust gas control apparatus for an engine according to an eighth embodiment of the invention.
Figure 19:
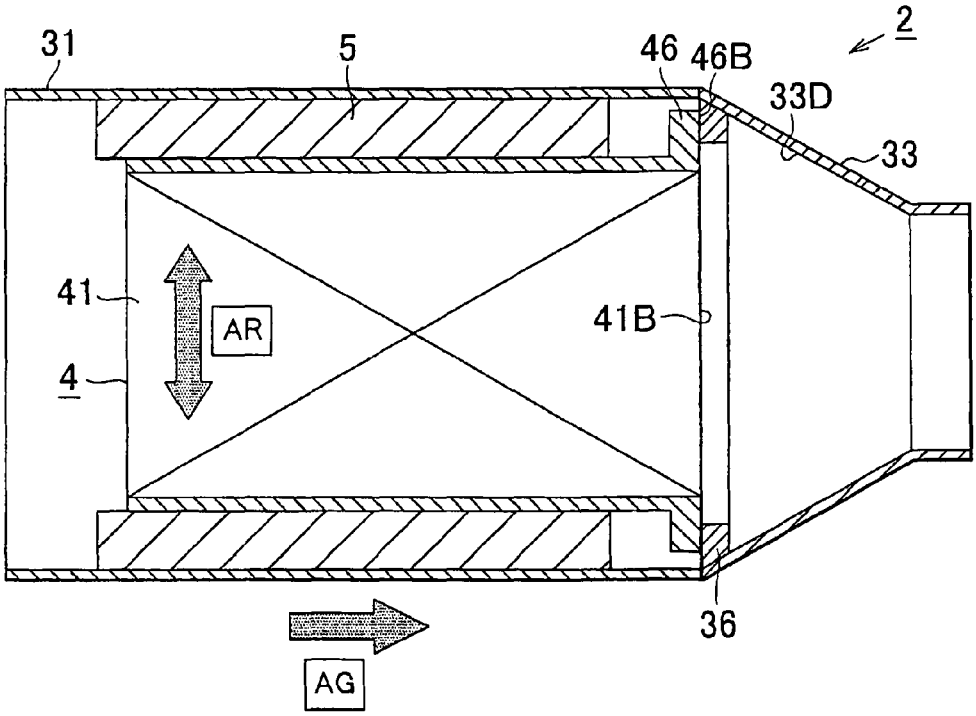
FIG. 19 the cross-sectional view of the exhaust gas control apparatus according to the eighth embodiment of the invention, which illustrates the state where the filter has been moved.

As shown in FIG. 18, in the exhaust gas control apparatus 2, the shock-absorbing member 36 is provided on the downstream-side end face 46B of the second flange 46. The shock-absorbing member 36 is provided to the second flange 46 so as not to block the cells 44 of the filter body 41. With this structure, when the filter 4 moves with respect to the filter case 3 and the mat 5 in the downstream direction, the shock-absorbing member 36 and the third case 33 comes into contact with each other, as shown in FIG. 19. Accordingly, even if the filter 4 moves with respect to the filter case 3 and the mat 5 due to an excessively high pressure applied to the filter 4, contact between the filter case 3 and the filter 4 is suppressed.

Effects of the Eighth Embodiment of the Invention

As described above in detail, the exhaust gas control apparatus 2 according to the eighth embodiment of the invention produces the following effects.

(1) In the exhaust gas control apparatus 2 according to the eighth embodiment of the invention, the shock-absorbing member 36 is provided on the downstream-side end face 46B of the second flange 46. Accordingly, it is possible to suppress contact between the filter case 3 and the filter 4, which is caused by the movement of the filter 4.

(2) Because the second flange 46 is formed on the filter 4, the shock-absorbing member 36 is provided to the filter 4 without blocking the cells 44. Accordingly, it is possible to suppress an increase in the pressure of the exhaust gas. In addition, it is possible to suppress reduction in the fuel efficiency of the engine 1.

Modified Examples of the Embodiments of the Invention

Figure 20:
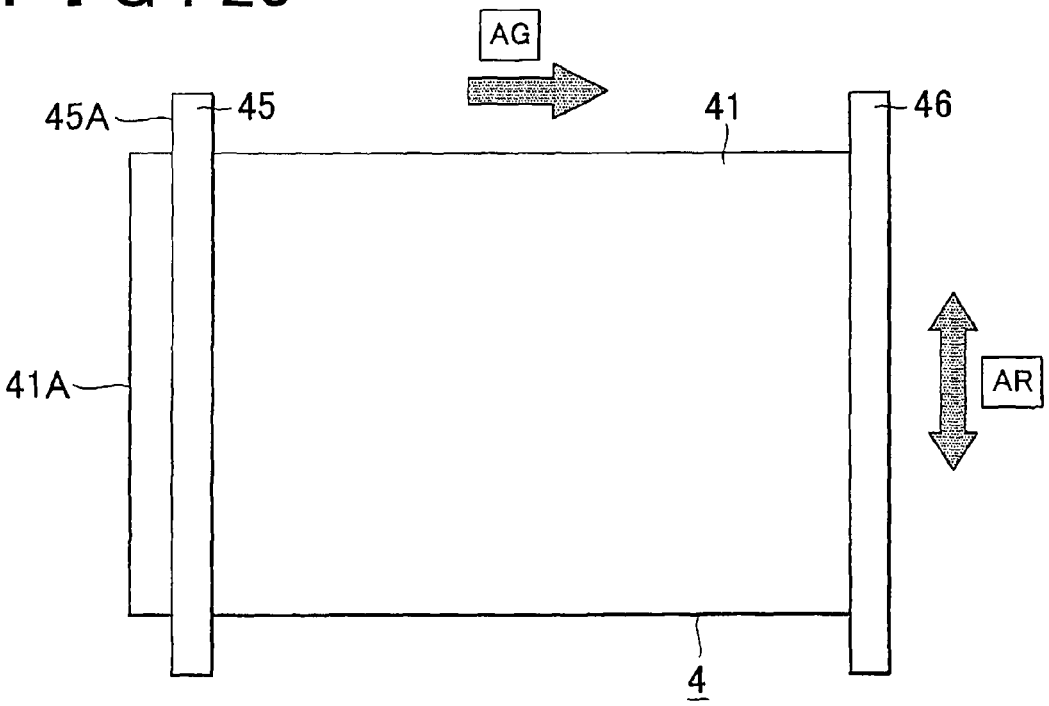
FIG. 20 is the plane view showing the structure of a portion of the filter included in an exhaust gas control apparatus for an engine according to another embodiment of the invention, the portion being near a flange.

Each of the embodiments described above may be modified as follows. In each embodiment described above, the filter 4 is formed such that the upstream-side end face 41A of the filter body 41 and the upstream-side end face 45A of the first flange 45 (or the upstream-side end face 47A of the third flange 47) are in substantially the same plane. Alternatively, a level difference may be made between the upstream-side end face 41A and the upstream-side end face 45A (or the upstream-side end face 47A), as shown in FIG. 20.

Figure 21:
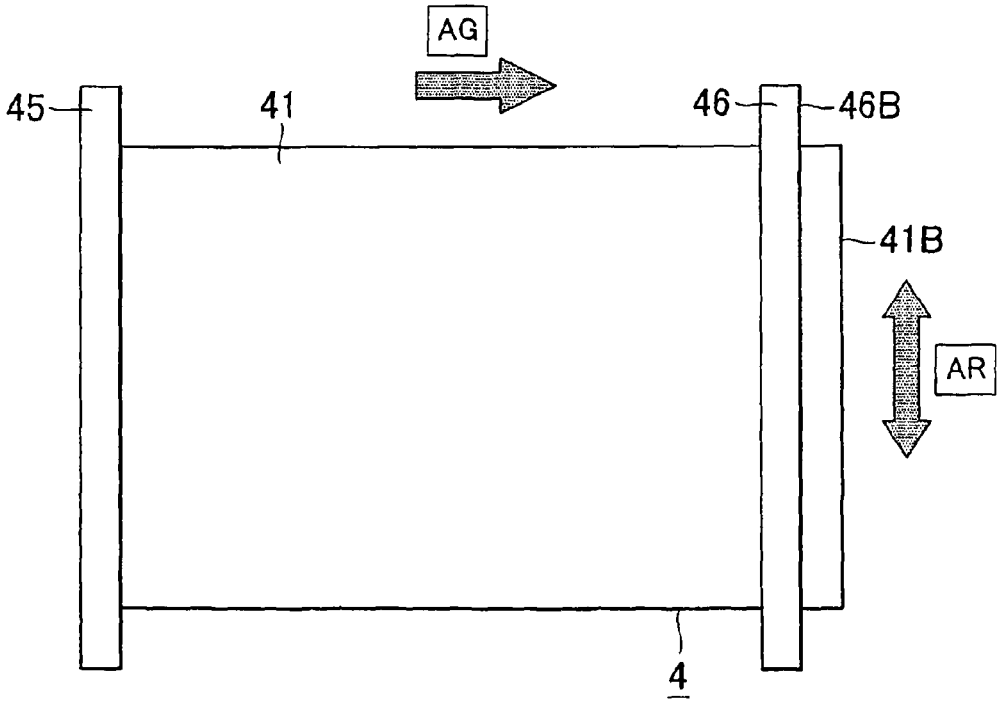
FIG. 21 is the plane view showing the structure of a portion of the filter included in an exhaust gas control apparatus for an engine according to another embodiment of the invention, the portion being near a flange.

In each embodiment described above, the filter 4 is formed such that the downstream-side end face 41B of the filter body 41 and the downstream-side end face 46B of the second flange 46 (or the downstream-side end face 48B of the fourth flange 48) are in substantially the same plane. Alternatively, a level difference may be made between the downstream-side end face 41B and the downstream-side end face 46B (or the downstream-side end face 48B), as shown in FIG. 21.

Figure 22:
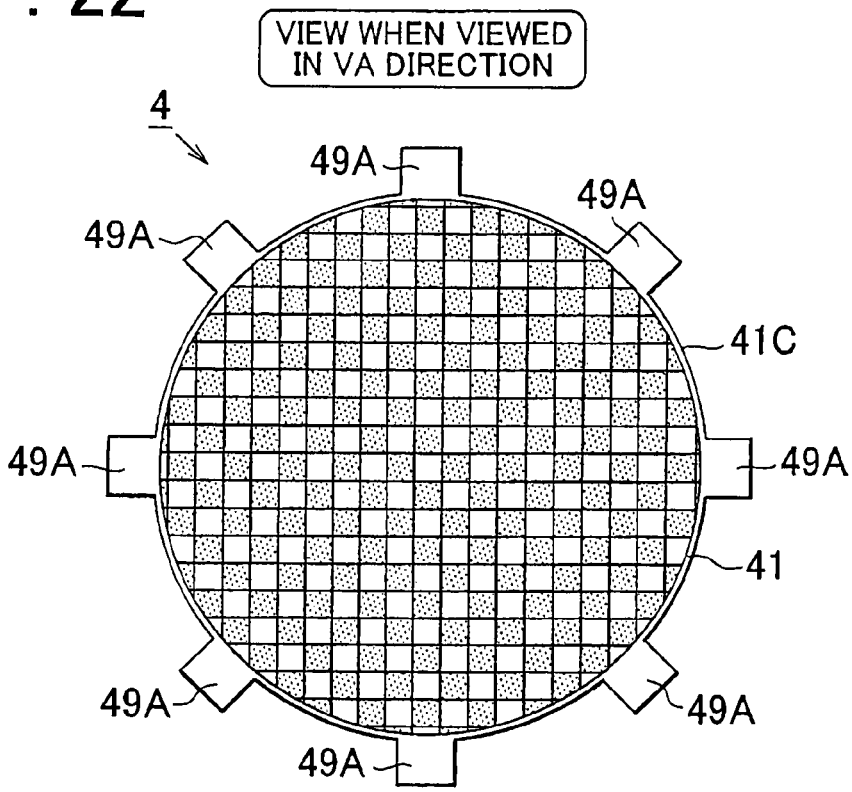
FIG. 22 is the plane view showing the plane structure of the filter included in an exhaust gas control apparatus for an engine according to another embodiment of the invention.

In each embodiment described above, the first flange 45 (or the third flange 47) is provided at a position upstream of the filter body 41, as an assisting body that is engaged with the mat 5 (or the filter case 3) to restrict the movement of the filter 4. However, such assisting body provided at a position upstream of the filter body 41 is not limited to a flange. For example, as shown in FIG. 22, an assisting body may be formed of at least one projection 49A which is formed on the upstream-side portion of the outer peripheral face 41C of the filter body 41 and which projects from the outer peripheral face 41C in the radial direction AR.

Figure 23:
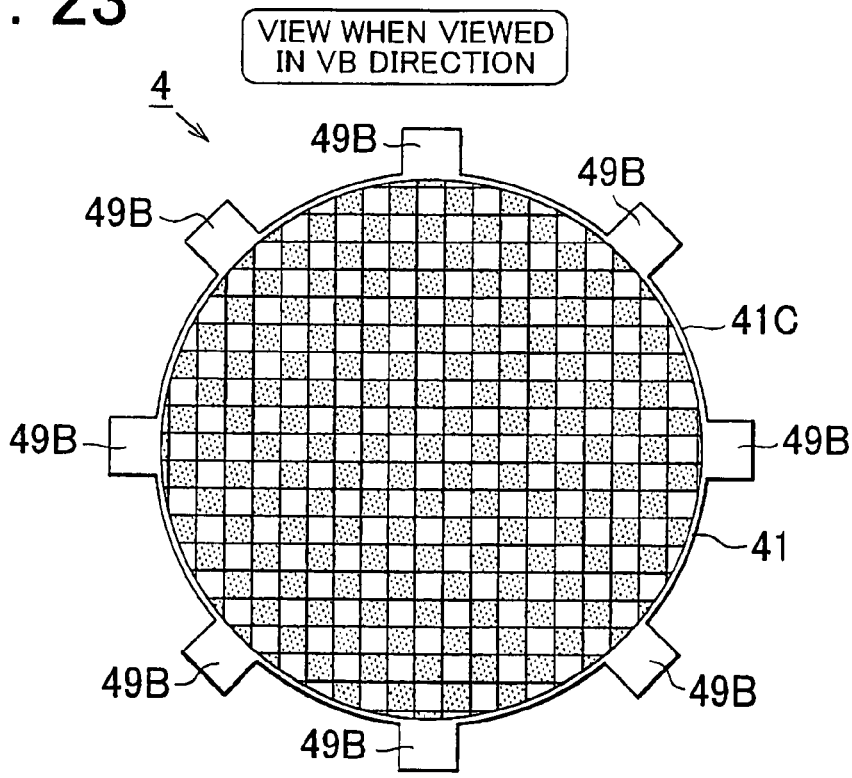
FIG. 23 is the plane view showing the plane structure of the filter included in an exhaust gas control apparatus for an engine according to another embodiment of the invention.

In each embodiment described above, the second flange 46 (or the fourth flange 48) is provided at a position downstream of the filter body 41, as an assisting body that is engaged with the retainer 6 (or the filter case 3) to restrict the movement of the filter 4. However, such assisting body provided at a position downstream of the filter body 41 is not limited to a flange. For example, as shown in FIG. 23, an assisting body may be formed of at least one projection 49B which is formed on the downstream-side portion of the outer peripheral face 41C of the filter body 41 and which projects from the outer peripheral face 41C in the radial direction AR.

The embodiments described above may be combined with each other as needed. In each embodiment described above, the mat 5 formed of alumina fibers is employed. However, the material of the mat 5 may be changed as needed.

Each embodiment of the invention described above is applied to the exhaust gas control apparatus 2 in which the NOx catalyst is supported by the filter 4. Alternatively, each embodiment of the invention described above may be applied to an exhaust gas control apparatus in which a NOx catalyst is not provided.

Each embodiment of the invention described above is applied to the exhaust gas control apparatus 2 that purifies the exhaust gas by trapping PM. Alternatively, each embodiment of the invention may be applied to an exhaust gas control apparatus in which PM is not trapped, namely, the exhaust gas is purified using only a catalyst.

Each embodiment of the invention described above is applied to the exhaust gas control apparatus 2 for a diesel engine. Alternatively, each embodiment of the invention may be applied to an exhaust gas control apparatus for another type of engine. In other words, each embodiment of the invention may be applied to any types of exhaust gas control apparatuses in which a toxic substance in the exhaust gas is removed so as not to be discharged to the outside using a purification structural body stored in a case.

While the invention has been described with reference to what are considered to be example embodiments thereof, it is to be understood that the invention is not limited to the described embodiments or constructions. On the contrary, the invention is intended to cover various modifications and equivalent arrangements. In addition, while the various elements of the described invention are shown in various combinations and configurations, which are example, other combinations and configurations, including more, less or only a single element, are also within the scope of the appended claims.

The invention claimed is:

1. An exhaust gas control apparatus for an engine, comprising:

a housing that has an internal space;

a purification structural body that is arranged in the housing and that purifies exhaust gas; and a holding member that is arranged, in a compressed state, between the purification structural body and the housing, wherein the purification structural body includes a main body that has an exhaust passage through which the exhaust gas flows and an assisting body that is provided on an outer peripheral face of the main body, the purification structural body is arranged in the housing such that the holding member and the assisting body are engaged with each other when the purification structural body moves in a downstream direction with respect to the housing, and an amount of a clearance left between the assisting body and the holding member is set such that, when the purification structural body moves with respect to the housing in the downstream direction, the assisting body comes into contact with the holding member before the purification structural body comes into contact with the housing.

2. The exhaust gas control apparatus for an engine according to claim 1, wherein the holding member and the assisting body are engaged with each other when a downstream-side end face of the assisting body comes into contact with the holding member.

3. An exhaust gas control apparatus for an engine, comprising:

a housing that has an internal space;

a purification structural body that is arranged in the housing and that purifies exhaust gas; and a holding member that is arranged, in a compressed state, between the housing and the purification structural body, wherein the purification structural body includes a main body that has an exhaust passage through which the exhaust gas flows and an assisting body that is provided on an outer peripheral face of the main body, a movement of the purification structural body in a downstream direction is restricted by engagement of the holding member with the assisting body when a force that moves the purification structural body with respect to the housing in the downstream direction is applied to the purification structural body, and an amount of a clearance left between the assisting body and the holding member is set such that, when the purification structural body moves with respect to the housing in the downstream direction, the assisting body comes into contact with the holding member before the purification structural body comes into contact with the housing.

4. An exhaust gas control apparatus for an engine, comprising:

a housing that has an internal space;

a purification structural body that is arranged in the housing and that purifies exhaust gas; and a holding member that is arranged, in a compressed state, between the housing and the purification structural body, wherein the purification structural body includes a main body that has an exhaust passage through which the exhaust gas flows and an assisting body that is provided on an outer peripheral face of the main body, the assisting body and the holding member face each other with a clearance left between a downstream-side end face of the assisting body and the holding member that allows movement of the purification structural body in a downstream direction with respect to the housing, and an amount of the clearance left between the assisting body and the holding member is set such that, when the purification structural body moves with respect to the housing in the downstream direction, the assisting body comes into contact with the holding member before the purification structural body comes into contact with the housing.

5. The exhaust gas control apparatus for an engine according to claim 1, wherein the assisting body is provided at an upstream-side end portion of the purification structural body.

6. An exhaust gas control apparatus for an engine, comprising:

a housing that has an internal space; and a purification structural body that is arranged in the housing and that purifies exhaust gas;

wherein the purification structural body includes a main body that has an exhaust passage through which the exhaust gas flows and an assisting body that is provided on an outer peripheral face of the main body, the purification structural body is arranged in the housing with the holding member and the assisting body engaged with each other, the purification structural body is arranged in the housing such that the holding member and the assisting body are engaged with each other when the purification structural body moves in a downstream direction with respect to the housing, and an amount of a clearance left between the assisting body and the holding member is set such that, when the purification structural body moves with respect to the housing in the downstream direction, the assisting body comes into contact with the holding member before the purification structural body comes into contact with the housing.

7. The exhaust gas control apparatus for an engine according to claim 6, wherein the housing and the assisting body are engaged with each other when a downstream-side end face of the assisting body and a portion of the housing come into contact with each other.

8. The exhaust gas control apparatus for an engine according to claim 6, further comprising:

a holding member that is arranged, in a compressed state, between the housing and the purification structural body.

9. The exhaust gas control apparatus for an engine according to claim 6, wherein the assisting body is provided at an upstream-side end portion of the purification structural body.

10. An exhaust gas control apparatus for an engine, comprising:

a purification structural body that purifies exhaust gas; and a housing that stores the purification structural body, wherein the purification structural body including a main body that has an exhaust passage through which the exhaust gas flows and an assisting body that is provided on an outer peripheral face of the main body is provided with a restricting member that restricts a movement of the purification structural body with respect to the housing in a downstream direction, the purification structural body is arranged in the housing with the restricting member and the assisting body engaged with each other, the purification structural body is arranged the housing such that a holding member and the assisting body are engaged with each other when the purification structural body moves in the downstream direction with respect to the housing, and an amount of a clearance left between the assisting body and the holding member is set such that, when the purification structural body moves with respect to the housing in the downstream direction, the assisting body comes into contact with the holding member before the purification structural body comes into contact with the housing.

11. The exhaust gas control apparatus for an engine according to claim 10, wherein the restricting member and the assisting body are engaged with each other when a downstream-side end face of the assisting body and the restricting member come into contact with each other.

12. The exhaust gas control apparatus for an engine according to claim 10, wherein the restricting member is arranged so as not to block the exhaust passage formed in the main body of the purification structural body.

13. The exhaust gas control apparatus for an engine according to claim 10, wherein the restricting member is a retainer.

14. The exhaust gas control apparatus for an engine according to claim 10, wherein the restricting member is a portion of the housing.

15. The exhaust gas control apparatus for an engine according to claim 10, further comprising:

a holding member that is arranged, in a compressed state, between the housing and the purification structural body.

16. The exhaust gas control apparatus for an engine according to claim 1, wherein the holding member is a mat made of alumina fibers.

17. The exhaust gas control apparatus for an engine according to claim 1, wherein a clearance is left between an outer peripheral face of the assisting body and the housing.

18. The exhaust gas control apparatus for an engine according to claim 1, wherein the assisting body is a flange provided on the main body of the purification structural body.

19. The exhaust gas control apparatus for an engine according to claim 18, wherein an outer diameter of the assisting body is larger than an inner diameter of the holding member.

20. An exhaust gas control apparatus for an engine, comprising:

a housing that has an internal space;

a purification structural body that is arranged in the housing and that purifies exhaust gas; and a holding member that is arranged, in a compressed state, between the housing and the purification structural body, wherein a shock-absorbing member is provided on a downstream-side end face of the purification structural body, the purification structural body is arranged in the housing such that the holding member and an assisting body are engaged with each other when the purification structural body moves in a downstream direction with respect to the housing, and an amount of a clearance left between the assisting body and the holding member is set such that, when the purification structural body moves with respect to the housing in the downstream direction, the assisting body comes into contact with the holding member before the purification structural body comes into contact with the housing.

21. The exhaust gas control apparatus for an engine according to claim 20, wherein the purification structural body includes a main body that has an exhaust passage through which the exhaust gas flows and an assisting body that is provided on an outer peripheral face of the main body, a downstream-side end face of the assisting body is the downstream-side end face of the purification structural body, and the shock-absorbing member is provided to the assisting body.

22. An exhaust gas control apparatus for an engine, comprising:

a housing that has an internal space;

a purification structural body that is arranged in the housing and that purifies exhaust gas; and a holding member that is arranged, in a compressed state, between the housing and the purification structural body, wherein a shock-absorbing member is provided on an inner peripheral face of the housing, which faces a downstream-side end face of the purification structural body, the purification structural body is arranged in the housing such that the holding member and the assisting body are engaged with each other when the purification structural body moves in a downstream direction with respect to the housing, and an amount of a clearance left between the assisting body and the holding member is set such that, when the purification structural body moves with respect to the housing in the downstream direction, the assisting body comes into contact with the holding member before the purification structural body comes into contact with the housing.

23. The exhaust gas control apparatus for an engine according to claim 22, wherein the purification structural body includes a main body that has a passage through which the exhaust gas flows and an assisting body that is provided on an outer peripheral face of the main body, a downstream-side end face of the assisting body is the downstream-side end face of the purification structural body, and the shock-absorbing member is provided on the inner peripheral face of the housing, which faces the downstream-side end face of the assisting body.

24. The exhaust gas control apparatus for an engine according to claim 1, wherein the purification structural body is configured to remove a toxic substance in the exhaust gas using a catalyst.

25. The exhaust gas control apparatus for an engine according to claim 1, wherein the purification structural body is configured to trap particulate matter in the exhaust gas.

* * * * *